US009630036B2

(12) United States Patent
Strum et al.

(10) Patent No.: US 9,630,036 B2
(45) Date of Patent: Apr. 25, 2017

(54) SAFETY CABINET WITH INTERLOCK MECHANISM

(71) Applicant: Justrite Manufacturing Company L.L.C., Des Plaines, IL (US)

(72) Inventors: Brandon Gene Strum, Lafayette, IN (US); Ronald Frank Auer, Matoon, IL (US)

(73) Assignee: Justrite Manufacturing Company LLC, Des Plaines, IL (US)

( * ) Notice: Subject to any disclaimer, the term of this patent is extended or adjusted under 35 U.S.C. 154(b) by 0 days.

(21) Appl. No.: 13/757,376

(22) Filed: Feb. 1, 2013

(65) Prior Publication Data

US 2013/0193818 A1 Aug. 1, 2013

Related U.S. Application Data

(60) Provisional application No. 61/593,680, filed on Feb. 1, 2012.

(51) Int. Cl.
*E05C 1/08* (2006.01)
*A62C 2/24* (2006.01)
(Continued)

(52) U.S. Cl.
CPC ..... *A62C 2/242* (2013.01); *A62C 3/002* (2013.01); *A62C 3/14* (2013.01); *E05B 65/02* (2013.01);
(Continued)

(58) Field of Classification Search
CPC . E05C 1/08; E05C 9/043; E05C 9/046; E05C 9/185; A62C 2/242; A62C 3/002;
(Continued)

(56) References Cited

U.S. PATENT DOCUMENTS 177,207 A 5/1876 Chandler
188,512 A 3/1877 Harlow
(Continued)

FOREIGN PATENT DOCUMENTS

DE 834348 3/1952
DE 9108804.6 11/1991
(Continued)

OTHER PUBLICATIONS

International Search Report prepared by the International Searching Authority in International Application No. PCT/US2013/024440, mailed on Apr. 15, 2013.
(Continued)

*Primary Examiner* — James O Hansen
(74) *Attorney, Agent, or Firm* — Leydig, Voit & Mayer, Ltd.

(57) ABSTRACT

A safety cabinet is disclosed which includes an enclosure having a double-wall construction and at least one door to selectively seal the enclosure. The safety cabinet includes a latch system for selectively retaining the door(s) in a closed position to cover the enclosure. The safety cabinet can be used to store, for example, flammable liquids, flammable waste, corrosives, pesticides, or combustible waste. The latch system includes fusible links that fuse when exposed to high ambient temperatures and cause the latch system to further engage the enclosure, thereby promoting the interlocking relationship between the door(s) and the enclosure when the safety cabinet is exposed to threshold high ambient temperatures.

17 Claims, 17 Drawing Sheets

(51) Int. Cl.

| | |
|---|---|
| ***A62C 3/00*** | (2006.01) |
| ***A62C 2/06*** | (2006.01) |
| ***E05B 65/10*** | (2006.01) |
| ***E05B 65/02*** | (2006.01) |
| ***E05C 9/04*** | (2006.01) |
| ***E05C 9/18*** | (2006.01) |
| *A62C 3/06* | (2006.01) |
| *E05G 1/04* | (2006.01) |

(52) U.S. Cl.
CPC ..... *E05B 65/104* (2013.01); *E05C 1/08* (2013.01); *E05C 9/043* (2013.01); *E05C 9/046* (2013.01); *E05C 9/185* (2013.01); *A62C 3/06* (2013.01); *E05G 1/04* (2013.01); *Y10T 292/097* (2015.04)

(58) Field of Classification Search
CPC ..... A62C 3/14; E05B 65/025; E05B 65/02; E05B 65/104; E05Y 2900/21
USPC ..... 312/215, 222, 324, 326, 329, 319.1, 312/319.2, 409; 49/366, 367
See application file for complete search history.

(56) References Cited

U.S. PATENT DOCUMENTS 943,471 A 12/1909 Schoell
956,329 A 4/1910 Foster
981,843 A 1/1911 Davis
993,788 A 5/1911 Murphy
1,019,934 A 12/1911 Walker
1,176,407 A 3/1916 Shirey
1,366,598 A 1/1921 Schroeder
1,508,919 A 9/1924 Cain et al.
1,909,697 A 1/1932 Macbeth et al.
1,973,854 A 9/1934 Hoffman et al.
2,269,759 A 1/1942 Dollins
2,592,289 A 4/1952 Joyner
2,635,027 A 4/1953 Rasmussen
2,735,706 A 2/1956 Pelcin
2,913,296 A 11/1959 Martin
3,010,585 A 11/1961 Slikkers
3,023,068 A 2/1962 Haag et al.
3,044,631 A 7/1962 Greenman et al.
3,168,365 A 2/1965 Evans
3,269,788 A 8/1966 Kneer
3,280,606 A 10/1966 Howard et al.
3,376,669 A 4/1968 Johnston
3,403,954 A 10/1968 Williams
3,481,485 A 12/1969 Hess
3,516,198 A 6/1970 Lyons
3,623,785 A 11/1971 Williams
3,819,216 A 6/1974 Richardson
3,822,506 A 7/1974 Fishbach
3,830,016 A 8/1974 Levine
3,850,464 A 11/1974 Bisbing et al.
3,895,461 A 7/1975 Maynard, Jr. et al.
3,895,849 A 7/1975 Zehr
4,073,384 A 2/1978 Celeste
4,100,847 A 7/1978 Norton
4,106,229 A 8/1978 Schmid
4,126,330 A 11/1978 Poole
4,146,994 A * 4/1979 Williams ..... 49/367
4,191,412 A 3/1980 Lejkander
4,229,956 A 10/1980 Thorburn
4,231,597 A 11/1980 Pelcin
4,262,448 A 4/1981 Flider
4,265,051 A * 5/1981 Williams ..... 49/7
4,418,969 A 12/1983 Hettman
4,456,316 A 6/1984 Lundgren
4,517,765 A 5/1985 Mucha
4,548,436 A 10/1985 Cole, Jr.
4,583,324 A 4/1986 Storz et al.
4,619,076 A 10/1986 Livingston
4,671,014 A 6/1987 Lack
4,679,835 A 7/1987 Weinerman et al.
4,715,138 A 12/1987 Cherico
4,775,057 A 10/1988 Zingeser
4,782,675 A 11/1988 Thorburn
4,892,338 A 1/1990 Weinerman et al.
4,896,905 A 1/1990 Lehr et al.
4,940,299 A 7/1990 Lazenby
4,949,505 A 8/1990 Cohrs
4,967,512 A 11/1990 Schroder et al.
4,989,907 A 2/1991 Edmonds et al.
5,046,446 A 9/1991 Sumrall et al.
5,050,327 A 9/1991 Woltman
5,061,022 A 10/1991 Meriwether
5,072,977 A 12/1991 Millman et al.
5,077,940 A 1/1992 LaRose, Jr.
5,078,437 A 1/1992 Borgmeyer et al.
5,121,952 A 6/1992 Jason
5,127,340 A 7/1992 Maro et al.
5,158,329 A 10/1992 Schlack
5,172,944 A 12/1992 Munich et al.
5,176,437 A 1/1993 Remington
5,192,123 A 3/1993 Wallin
5,254,798 A 10/1993 Zoback
5,275,029 A 1/1994 Myers
D347,155 S 5/1994 Schlack et al.
5,307,653 A 5/1994 Davis
5,340,172 A 8/1994 Sweet
5,356,206 A 10/1994 Van Valkenburgh
5,377,622 A 1/1995 Lauttenbach et al.
D357,396 S 4/1995 Ziemer et al.
5,427,420 A 6/1995 Moore
5,452,929 A 9/1995 Anderson
D364,329 S 11/1995 Ziemer et al.
5,464,259 A 11/1995 Cohrs et al.
5,473,845 A 12/1995 Livingston et al.
5,493,881 A 2/1996 Harvey
D370,620 S 6/1996 Ziemer
5,582,472 A 12/1996 Lyons et al.
5,603,535 A 2/1997 Antonucci et al.
5,669,640 A 9/1997 Ryan
5,704,476 A 1/1998 Abbott
5,722,202 A 3/1998 Cooper
5,762,379 A 6/1998 Salmon
5,791,174 A 8/1998 Fitzgerald et al.
5,794,826 A 8/1998 Cronce et al.
5,795,043 A 8/1998 Johnson et al.
D399,121 S 10/1998 Alyanakian et al.
5,820,174 A 10/1998 Parikh et al.
5,878,608 A 3/1999 Alyanakian
5,934,716 A 8/1999 Koveal et al.
5,941,104 A 8/1999 Sadler
5,944,399 A * 8/1999 Gillispie ..... 312/324
5,974,842 A 11/1999 Schlack et al.
5,975,318 A 11/1999 Jay
5,983,682 A 11/1999 Parikh
5,992,098 A 11/1999 Flider et al.
D419,053 S 1/2000 Schlack
6,023,953 A 2/2000 Vickers et al.
6,050,618 A 4/2000 Tieu
D425,395 S 5/2000 Ji
6,058,748 A 5/2000 Beals, Jr. et al.
6,152,497 A 11/2000 Vickers et al.
6,250,014 B1 6/2001 Rusiana
6,250,015 B1 * 6/2001 Gillispie ..... 49/367
6,263,712 B1 7/2001 Ramsauer
6,293,130 B1 9/2001 Ramsauer
6,427,501 B2 8/2002 Ramsauer
6,470,610 B1 10/2002 Northey
6,481,252 B2 11/2002 Calle et al.
6,513,888 B1 2/2003 Lucht
6,543,821 B1 4/2003 Weinerman et al.
6,546,765 B1 4/2003 Linares
6,547,290 B1 4/2003 Zenner et al.
6,553,798 B1 4/2003 Larsen et al.
6,584,916 B1 7/2003 Felton et al.
6,623,052 B2 9/2003 Hansen
6,652,954 B2 11/2003 Nielsen et al.
6,657,123 B2 12/2003 Moore

(56) References Cited

U.S. PATENT DOCUMENTS

| | | | |
|---|---|---|---|
| 6,729,701 | B2 | 5/2004 | Carter et al. |
| 6,755,053 | B1 | 6/2004 | Dias |
| 6,854,304 | B2 | 2/2005 | Linares |
| 6,871,747 | B2 | 3/2005 | Bustos |
| 7,001,001 | B1 | 2/2006 | Spencer |
| 7,029,078 | B1 | 4/2006 | Fromme et al. |
| 7,275,770 | B2 | 10/2007 | Guebre-Tsadik et al. |
| 8,172,344 | B2 | 5/2012 | Eyer et al. |
| 2003/0001465 | A1 | 1/2003 | Carter et al. |
| 2004/0066122 | A1 | 4/2004 | Holmes |
| 2005/0110373 | A1 | 5/2005 | Assmann |
| 2005/0221042 | A1 | 10/2005 | Chirhart et al. |
| 2005/0224428 | A1 | 10/2005 | Weber |
| 2005/0262897 | A1 | 12/2005 | Parsons |
| 2006/0059934 | A1 | 3/2006 | Howington et al. |
| 2007/0205703 | A1 | 9/2007 | McLuckie et al. |
| 2008/0073914 | A1 | 3/2008 | Eller et al. |
| 2008/0106174 | A1 | 5/2008 | Marcus et al. |
| 2008/0211363 | A1 | 9/2008 | Carter et al. |
| 2008/0223091 | A1 | 9/2008 | Kroening et al. |
| 2009/0085447 | A1 | 4/2009 | McLuckie et al. |
| 2009/0091220 | A1 | 4/2009 | Eyer et al. |
| 2010/0213802 | A1 | 8/2010 | Backhaus |
| 2012/0242208 | A1 | 9/2012 | Eyer et al. |
| 2013/0200767 | A1 | 8/2013 | Mueller et al. |

FOREIGN PATENT DOCUMENTS

| | | | |
|---|---|---|---|
| DE | 29604679 | U | 5/1996 |
| DE | 29711737 | | 12/1998 |
| DE | 29711740 | | 12/1998 |
| DE | 20319136 | | 6/2005 |
| EP | 0156044 | A3 | 10/1985 |
| EP | 0893558 | | 1/1999 |
| EP | 1531218 | B1 | 2/2009 |
| FR | 2113501 | | 6/1972 |
| GB | 437577 | | 10/1935 |
| GB | 2028912 | | 3/1980 |
| WO | 2010/130440 | A1 | 11/2010 |

OTHER PUBLICATIONS

Written Opinion prepared by the International Searching Authority in International Application No. PCT/US2013/024440, mailed on Apr. 15, 2013.

European Patent Office, Extended Search Report in European Patent Application No. 13743604.4, dated Nov. 6, 2015, 7 pp.

Understanding Saftey Cabinets, http://www.justritemfg.com/pdf/UnderstandingSafetyCabinet.pdf, 5 pages (2012).

Safe-T-Store, www.prioritysupplies.com.au/brochure, 12 pages (2012).

Dangerous Goods Cabinets, www.dmdsheiving.com.aulindex, 2 pages (2012).

Flammable Liquids Storage Cabinets, www.hazchem.net.au, 3 pages (2006).

S.E.P.M.A.R. Safety Storage Cabinets, http:www.sepmar-firex.com.au/wp-content, 2 pages (2012).

* cited by examiner

SAFETY CABINET WITH INTERLOCK MECHANISM

CROSS-REFERENCE TO RELATED APPLICATIONS

This patent application claims the benefit of priority to U.S. Provisional Patent Application No. 61/593,680, filed on Feb. 1, 2012, and entitled "Safety Cabinet With Interlock Mechanism," which is incorporated in its entirety herein by this reference.

FIELD OF INVENTION

The present disclosure pertains generally to a safety cabinet for flammable, combustible, or other hazardous materials. More particularly, the present disclosure relates to a safety cabinet having an interlock mechanism to further secure a door to the enclosure in high-temperature conditions.

BACKGROUND

A safety cabinet for storing flammable or explosive materials is known in the art. Such a safety cabinet can be used for the onsite storage of flammable material at a plant, for example. The safety cabinet can be provided to insulate flammable material stored within it from the direct effects of an external fire to help prevent the flammable material from igniting and adding to the deleterious effect of the original fire. Often, either according to law or to an internal standard operating procedure, the safety cabinet is equipped with a locking mechanism, which can help prevent the inadvertent, improper usage of the flammable material and restrict access to the flammable material stored within the safety cabinet only to authorized personnel.

Nonetheless, these devices can be susceptible to the undesired opening of the doors when the ambient temperature increases, such as during a fire. Increased temperatures can cause warping of the safety cabinet, particularly at the latching interface between the cabinet and its doors. After a certain amount of warping, the volatile and combustible contents of the safety cabinet can be exposed to extreme heat and open flame.

It will be appreciated that this background description has been created by the inventors to aid the reader, and is not to be taken as an indication that any of the indicated problems were themselves appreciated in the art. While the described principles can, in some aspects and embodiments, alleviate the problems inherent in other systems, it will be appreciated that the scope of the protected innovation is defined by the attached claims, and not by the ability of any disclosed feature to solve any specific problem noted herein.

BRIEF SUMMARY

To provide improved safety cabinet integrity during extreme environmental conditions, embodiments of the present disclosure provide an interlock mechanism that operates in response to increased ambient temperature to help maintain a door of the safety cabinet in the closed position. In some embodiments, the interlock mechanism can be part of a three-point latch system. In other embodiments, the interlock mechanism is mounted to an enclosure and arranged such that it selectively engages a door mounted to the enclosure to further secure the door in a closed position relative to an opening of the enclosure in response to the ambient temperature reaching a predetermined threshold.

In one embodiment, a safety cabinet includes an enclosure, a door, and an interlock mechanism. The enclosure defines an opening. The door is rotatably attached to the enclosure. The door is moveable between an open position and a closed position. The door is configured to selectively cover at least a portion of the opening of the enclosure when in the closed position. The interlock mechanism is arranged with at least one of the enclosure and the door.

The interlock mechanism includes a mounting element, a fusible link, a catch, and a biasing mechanism. The fusible link interconnects the mounting element and the catch. The catch is movable over a range of travel between a retracted position, in which the catch is in non-interlocking relationship with the door and the enclosure, and an interlocked position, in which the catch is in interlocking relationship with the door and the enclosure when the door is in the closed position to constrain relative movement between the door and the enclosure. The biasing mechanism is arranged with the catch to urge the catch to the interlocked position. The fusible link is connected to the catch such that the catch is constrained from moving to the interlocked position by the fusible link. The fusible link is configured to melt at a predetermined temperature to thereby disconnect the catch from the mounting element to allow the biasing mechanism to move the catch relative to the mounting element to the interlocked position.

In another embodiment, a safety cabinet includes an enclosure, a door, a three-point latch system, and an interlock mechanism. The enclosure defines an opening. The door is rotatably attached to the enclosure. The door is moveable between an open position and a closed position. The door is configured to selectively cover at least a portion of the opening of the enclosure when in the closed position. The three-point latch system is disposed within the door. The three-point latch system is adapted to selectively retain the door in the closed position.

The interlock mechanism includes a catch. The interlock mechanism is arranged with at least one of the enclosure and the door. The interlock mechanism is adapted to operate in response to a predetermined, increased ambient temperature to move the catch into interlocking relationship, or into further interlocking relationship, with the door and the enclosure when the door is in the closed position to constrain the door from moving from the closed position.

In yet another embodiment, an interlock mechanism for selectively retaining a door of a safety cabinet in a closed position includes a mounting element, a fusible link, a catch, and a biasing mechanism. The fusible link is connected to both the mounting element and the catch. The catch is movable over a range of travel between a retracted position and an interlocked position. The biasing mechanism is arranged with the catch to urge the catch to the interlocked position. The fusible link is connected to the catch such that the catch is constrained from moving to the interlocked position by the fusible link. The fusible link is configured to melt at a predetermined temperature to thereby allow the biasing mechanism to move the catch to the interlocked position.

Further and alternative aspects and features of the disclosed principles will be appreciated from the following detailed descriptions and the accompanying drawings. As will be appreciated, the principles related to safety cabinets, latch systems and interlock mechanisms disclosed herein are capable of being carried out in other and different embodiments, and capable of being modified in various respects. Accordingly, it is to be understood that both the foregoing general description and the following detailed description are exemplary and explanatory only and do not restrict the scope of the disclosed principles.

DETAILED DESCRIPTION

Figure 1:
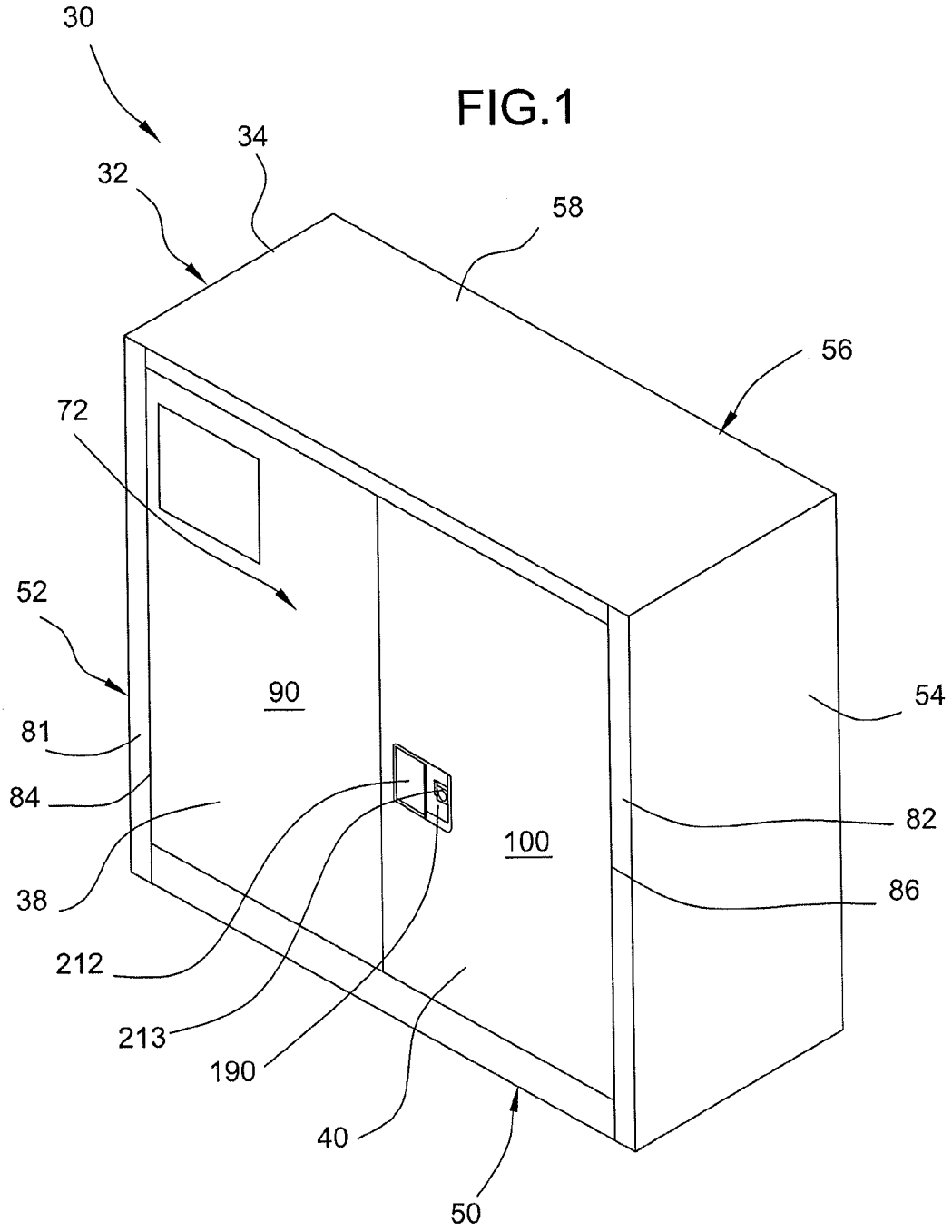
FIG. 1 is a perspective view of an embodiment of a safety cabinet constructed in accordance with principles of the present disclosure.

The present disclosure is directed to an interlock mechanism for a safety cabinet that operates in response to increased ambient temperature to help maintain a door of the safety cabinet in a closed position to further protect the contents stored in the interior of the safety cabinet from exposure to open flame and/or increased temperature as a result of a fire in the vicinity of the safety cabinet. In embodiments, the safety cabinet can include a three-point latch system incorporating the interlock mechanism. In other embodiments, the safety cabinet can include an interlock mechanism that is separate from any door latch present.

In some embodiments, the latch system can include spring-loaded latch rods and/or spring-loaded door latches that are connected to a door actuator to allow the latch rods and door latch to move to a retracted position so that the door can move from a closed position, in which it covers at least a portion of an opening of an enclosure, to an open position, in which the interior of the safety cabinet is accessible. Distal segments of the latch rods and the door latch can extend into apertures in the frame of the enclosure defining the opening and/or a second door used to cover the opening of the enclosure. The distal segments of the latch rods and the door latch can be beveled and spring-loaded to allow the door to be closed without the door actuator being operated. Once the door is in the closed position, the distal segments of the latch rods and the door latch spring back into an intermediate extended position to retain the door in the closed position.

The latch system can operate under normal temperature conditions to selectively move the latch rods and the door latch from the intermediate extended position to the retracted position by use of the door actuator. In the event of a fire with accompanying elevated ambient temperature around the safety cabinet, the interlock mechanism can operate to further interlock the door and the enclosure to retain the door in the closed position.

In one arrangement, the interlock mechanism comprises spring-loaded latch rods that are held in place for normal operation by a fusible link. When the fusible link melts in response to an elevated temperature condition, a spring is allowed to further act upon the distal latch rod segments so that they travel past the normal operating position to further interlock the door with the enclosure to retain the door in the closed position. An access panel can be provided to allow access to the distal latch rod segments to disengage the segments from the enclosure to allow the door to move from the closed position to the open position.

In other arrangements, an interlock mechanism can be provided that is separate from the latch system and is disposed to selectively interlock a door of the safety cabinet when the ambient temperature exceeds a threshold level. In some embodiments, the interlock mechanism can be mounted in a cabinet top or bottom or in the air space defined in a door having a double-walled construction.

In the event of a fire sufficient to melt the fusible links, the doors of the safety cabinet can be retained in the closed position. Operation of the door actuator will not move the interlock mechanism which will continue to operate to interlock the door with the enclosure. A user cannot open the door until the interlock mechanism is retracted manually by accessing it through an access panel.

Figure 2:
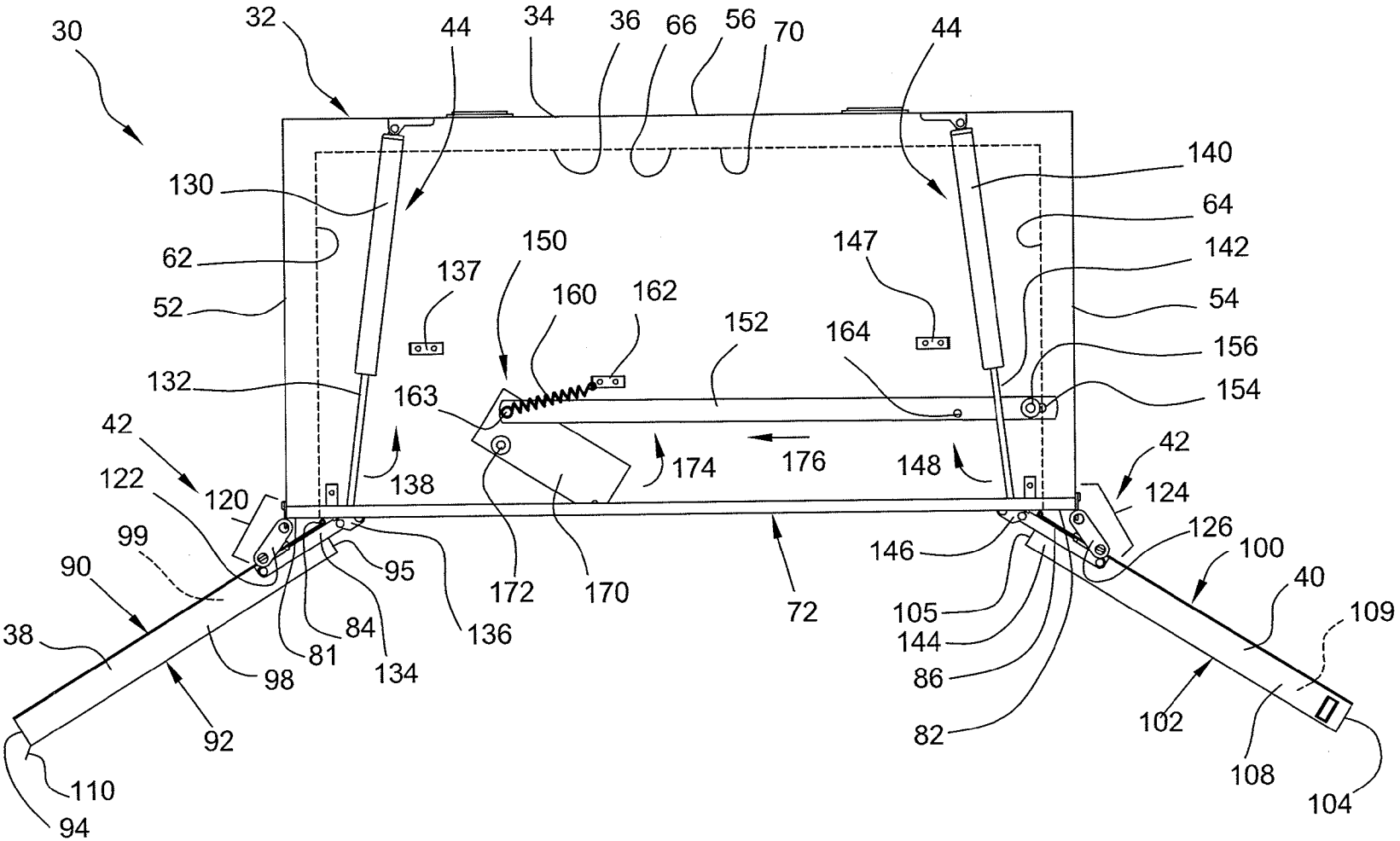
FIG. 2 is a top plan view of the safety cabinet of FIG. 1 with a top panel thereof removed for illustrative purposes.

Referring to FIG. 1, an embodiment of a safety cabinet 30 is shown. The safety cabinet 30 can be used to store flammable liquids, flammable waste, corrosives, pesticides, or combustible waste, for example. The safety cabinet 30 includes an enclosure 32 having an outer shell 34 and an inner shell 36, a left door 38, and a right door 40. Referring to FIG. 2, the safety cabinet 30 includes a retaining system 42 for retaining the doors 38, 40 in an open position and a closure system 44 for automatically closing the doors 38, 40 so that they move from an open position to the closed position (see, e.g., FIG. 1).

Figure 3:
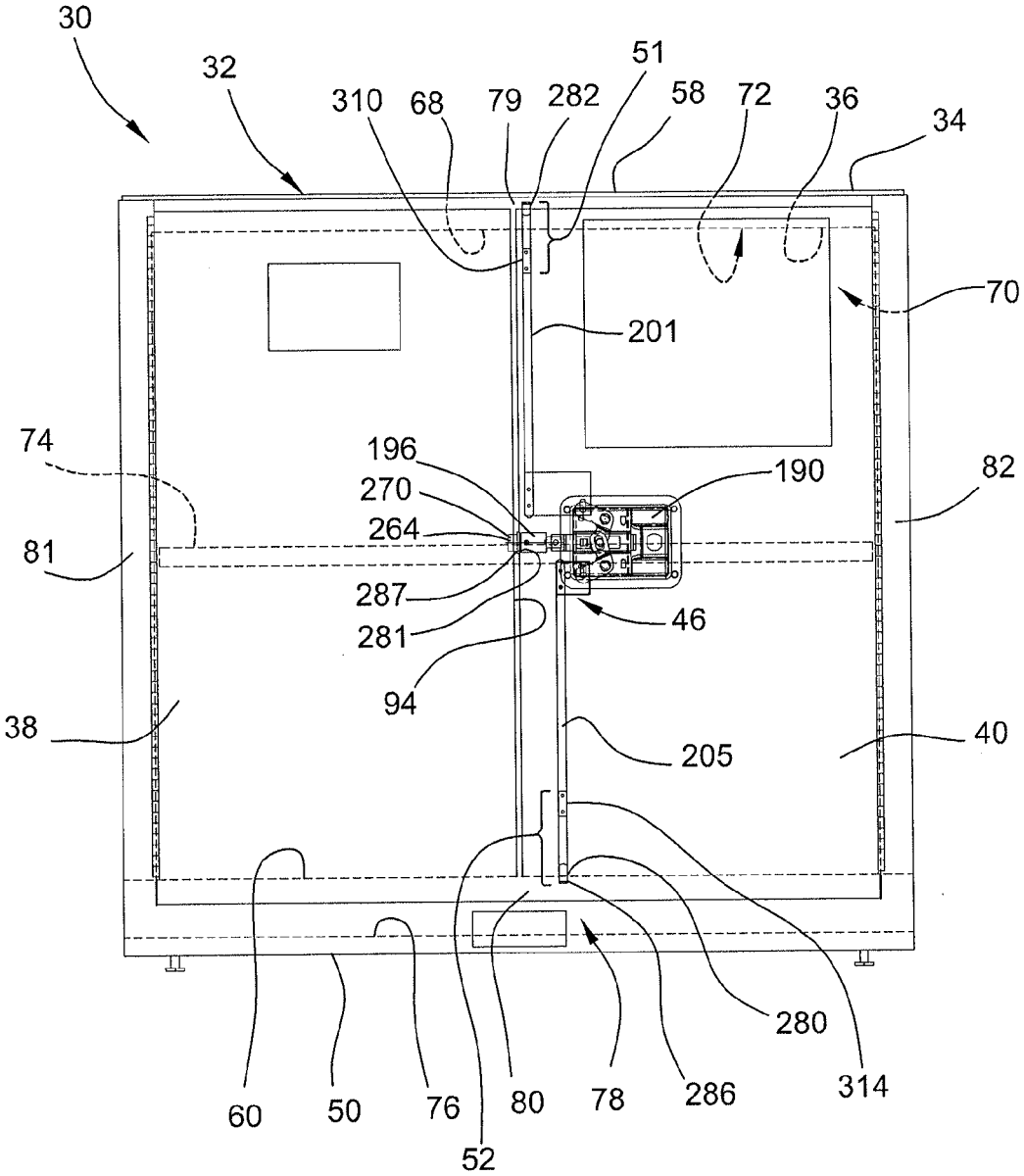
FIG. 3 is a front elevational view of the safety cabinet of FIG. 1.

Referring to FIG. 3, the safety cabinet 30 also includes a latch system 46 for latching the doors 38, 40 in the closed position to cover the opening of the enclosure 32. The latch system 46 can be a three-point latch system having various configurations.

The doors 38, 40 of the safety cabinet 30, which can have a double-walled construction to provide an insulative air space therebetween, can be placed in the closed position to help protect the contents stored therein from the harmful effects caused by an open flame and/or increased ambient temperature in the event of a fire. The latch system 46 includes a pair of interlock mechanisms 51, 52 each with a fusible link 310, 314 that allow the latch system 46 to become further engaged with the enclosure 32 in response to the ambient temperature exceeding a predetermined threshold. When the latch system 46 is further engaged with the enclosure 32, the doors 38, 40 of the safety cabinet 30 can be less likely to warp or to move to an open position with respect to the enclosure 32 when exposed to extreme heat. Reducing warping can help prevent the contents of the safety cabinet 30 from being exposed to flame and higher temperature.

Figure 4:
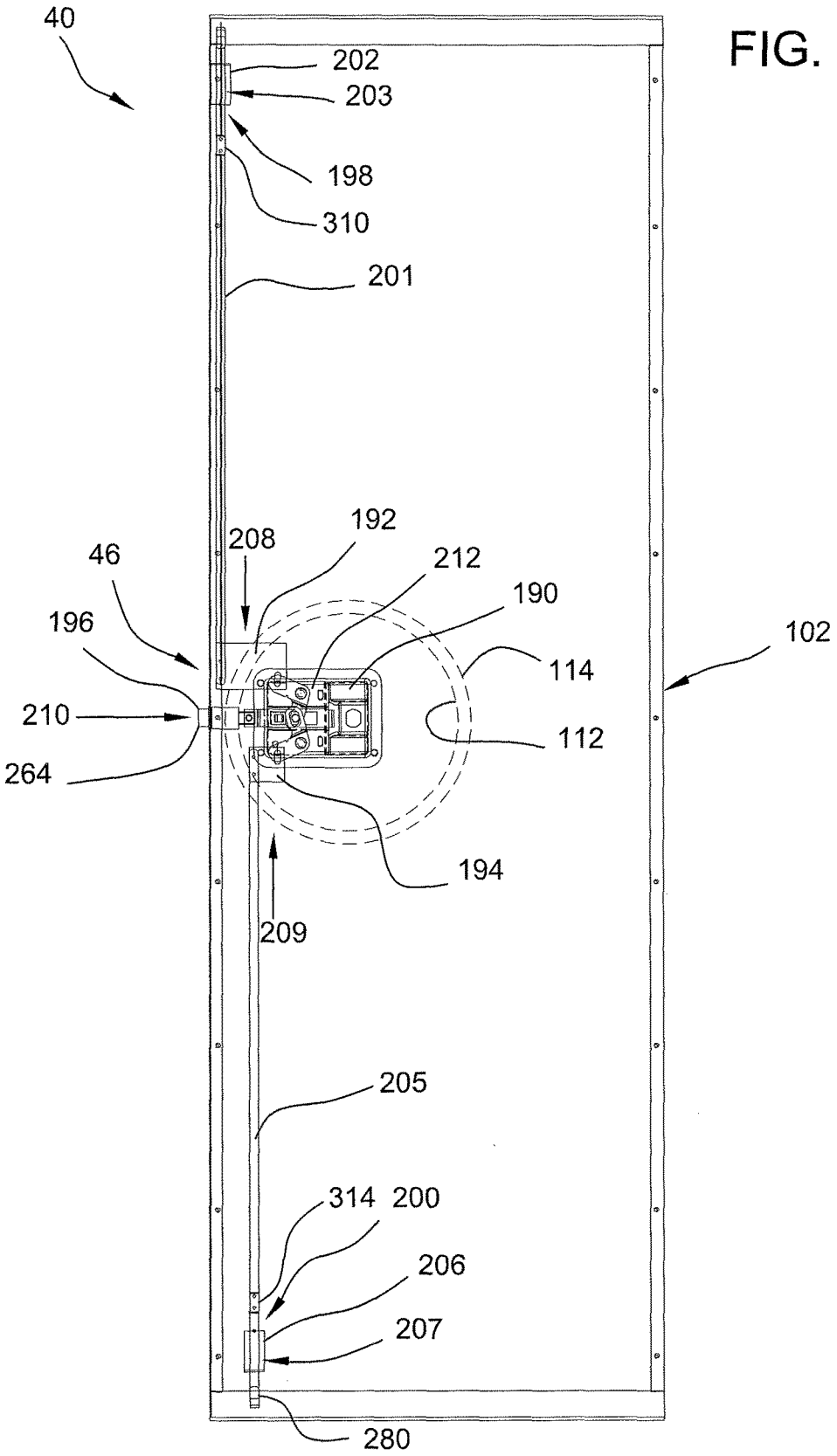
FIG. 4 is a front elevational view of a right door of the safety cabinet of FIG. 1.
Figure 5:
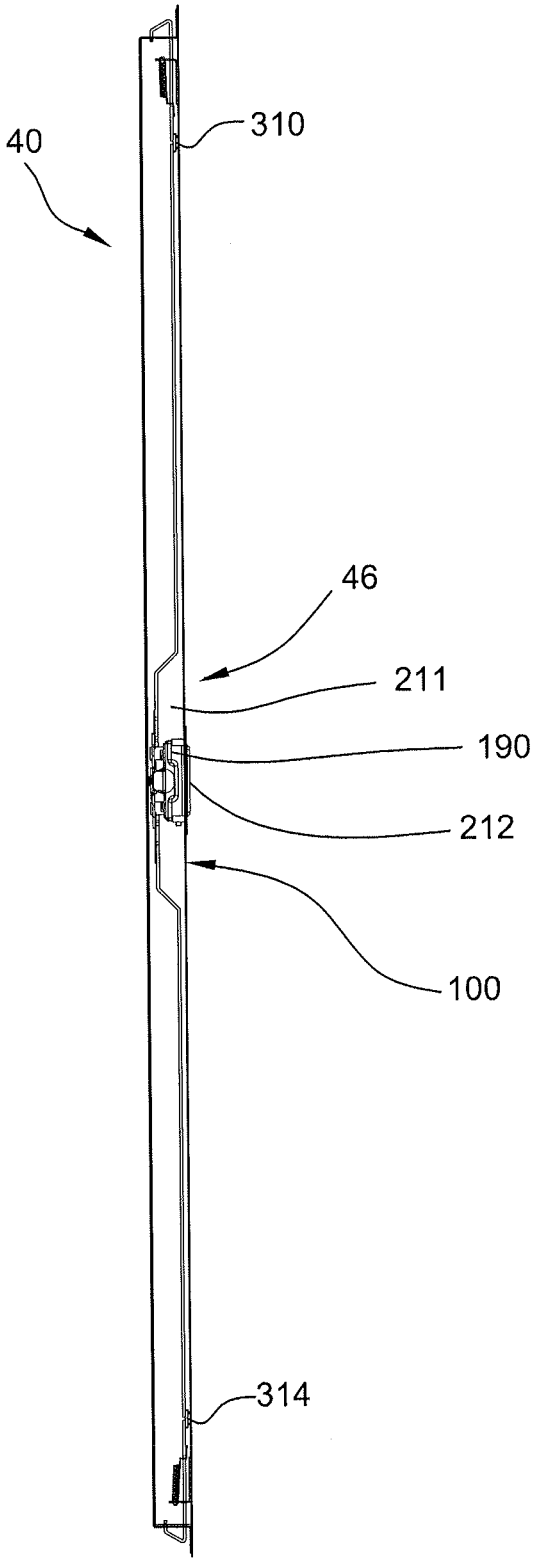
FIG. 5 is an end elevational view of the right door of FIG. 4.
Figure 6:
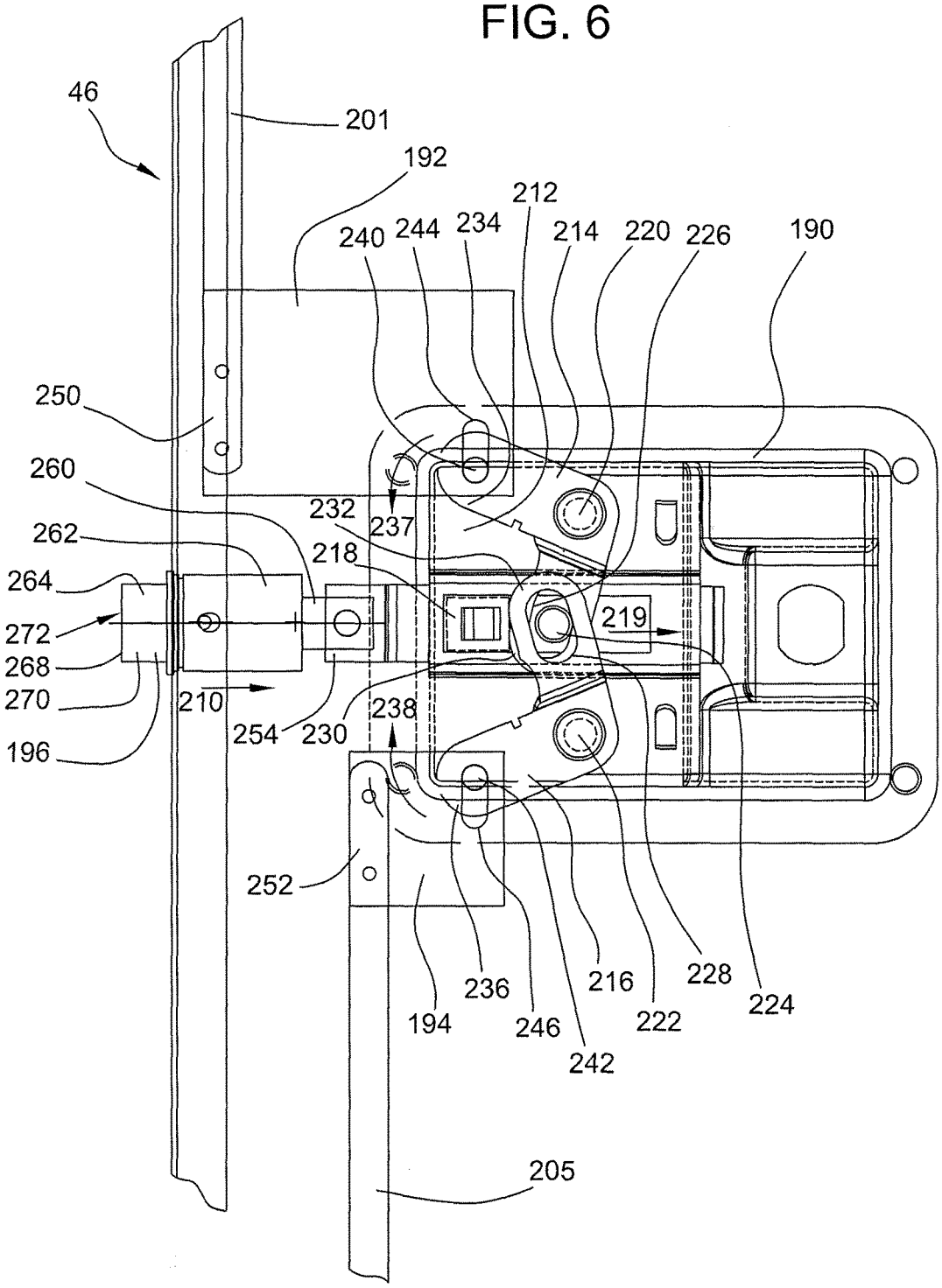
FIG. 6 is an enlarged, fragmentary front elevational view of a central portion of a latch system of the safety cabinet of FIG. 1.
Figure 7:
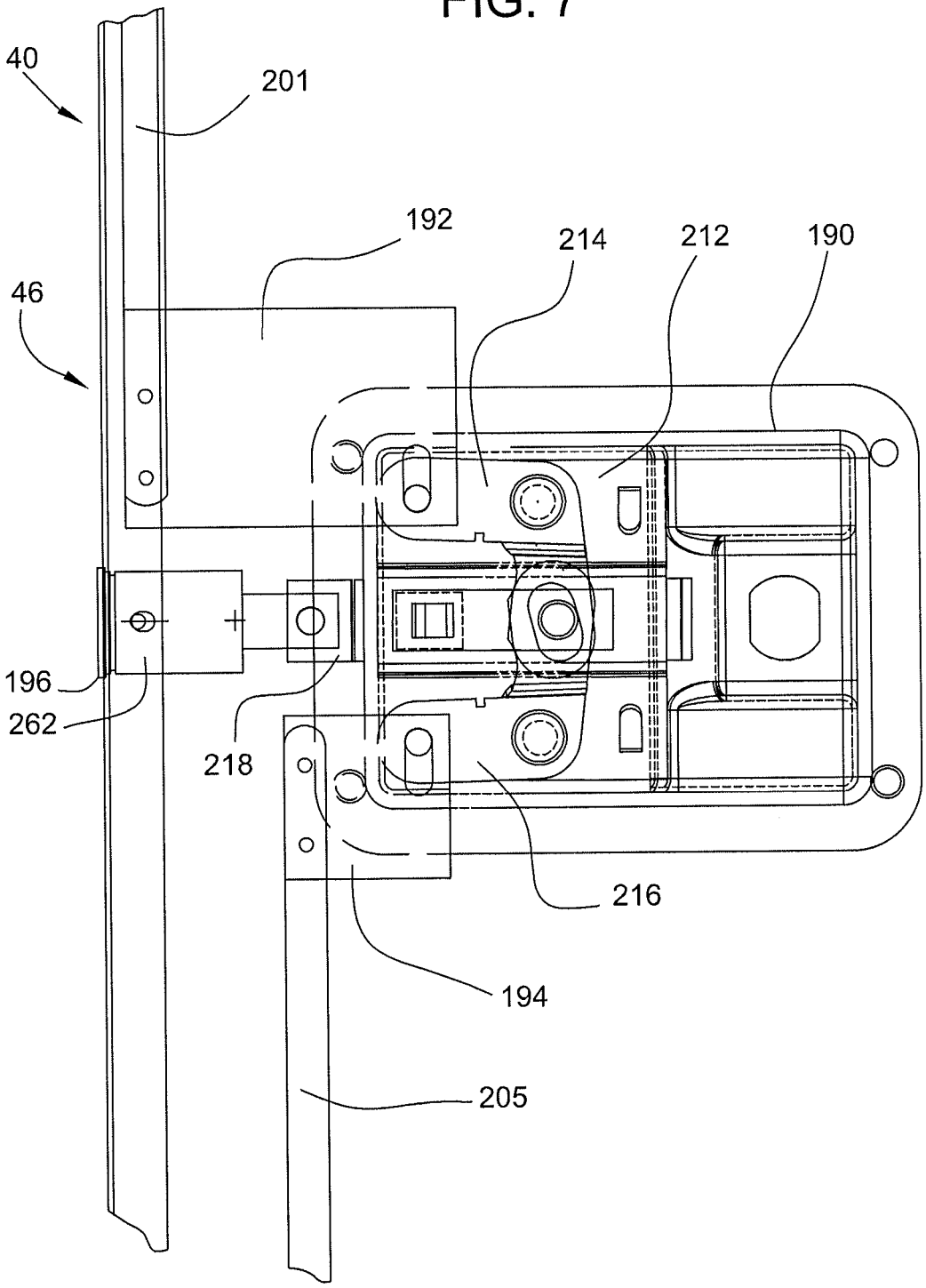
FIG. 7 is an enlarged, fragmentary front elevational view of the latch system of FIG. 6, illustrating the latch system in a released position.
Figure 8:
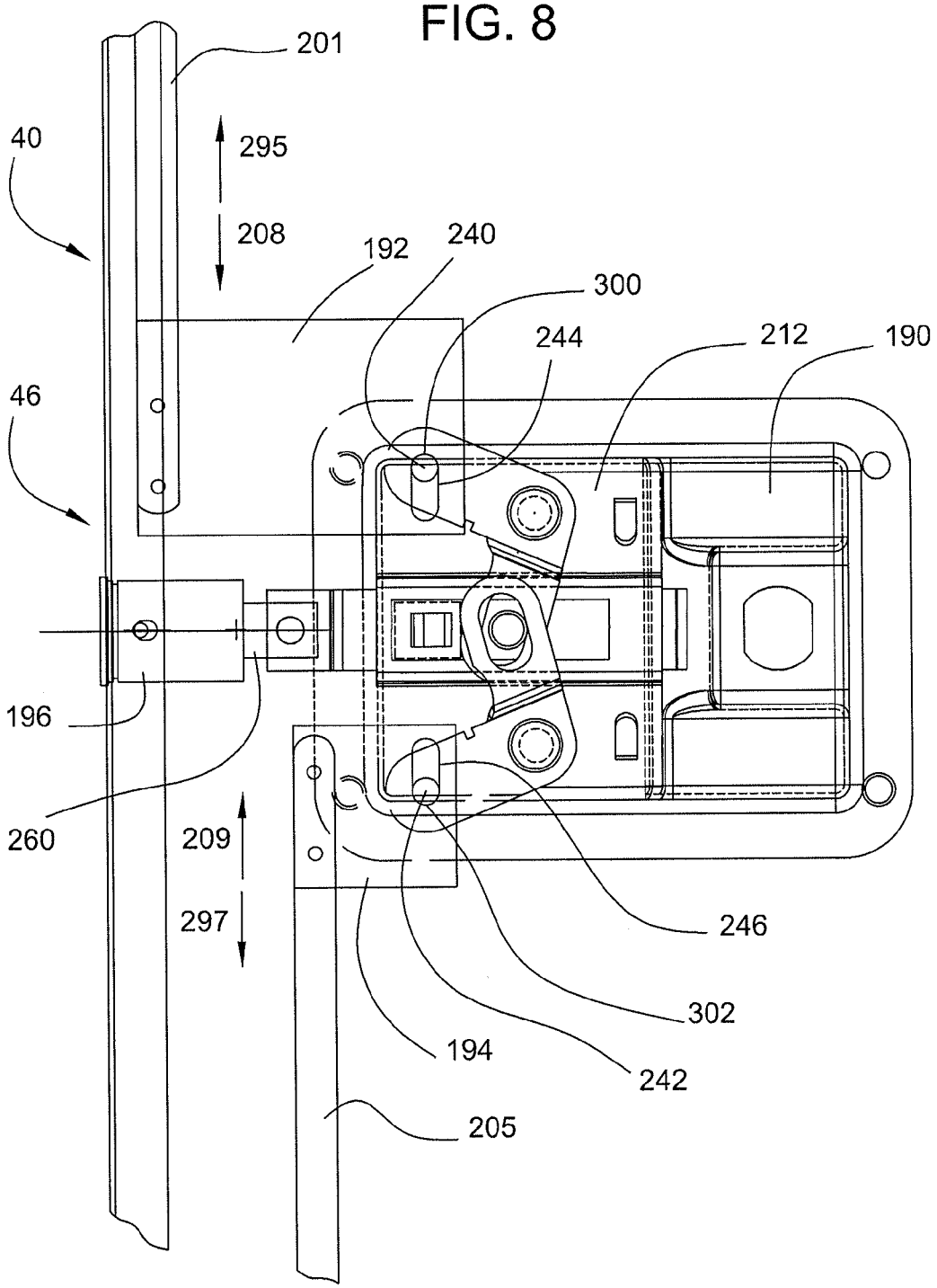
FIG. 8 is an enlarged, fragmentary front elevational view of the latch system of FIG. 1, illustrating the latch rods and a catch of the bullet slam latch each in a retracted position without actuating the paddle handle.
Figure 9:
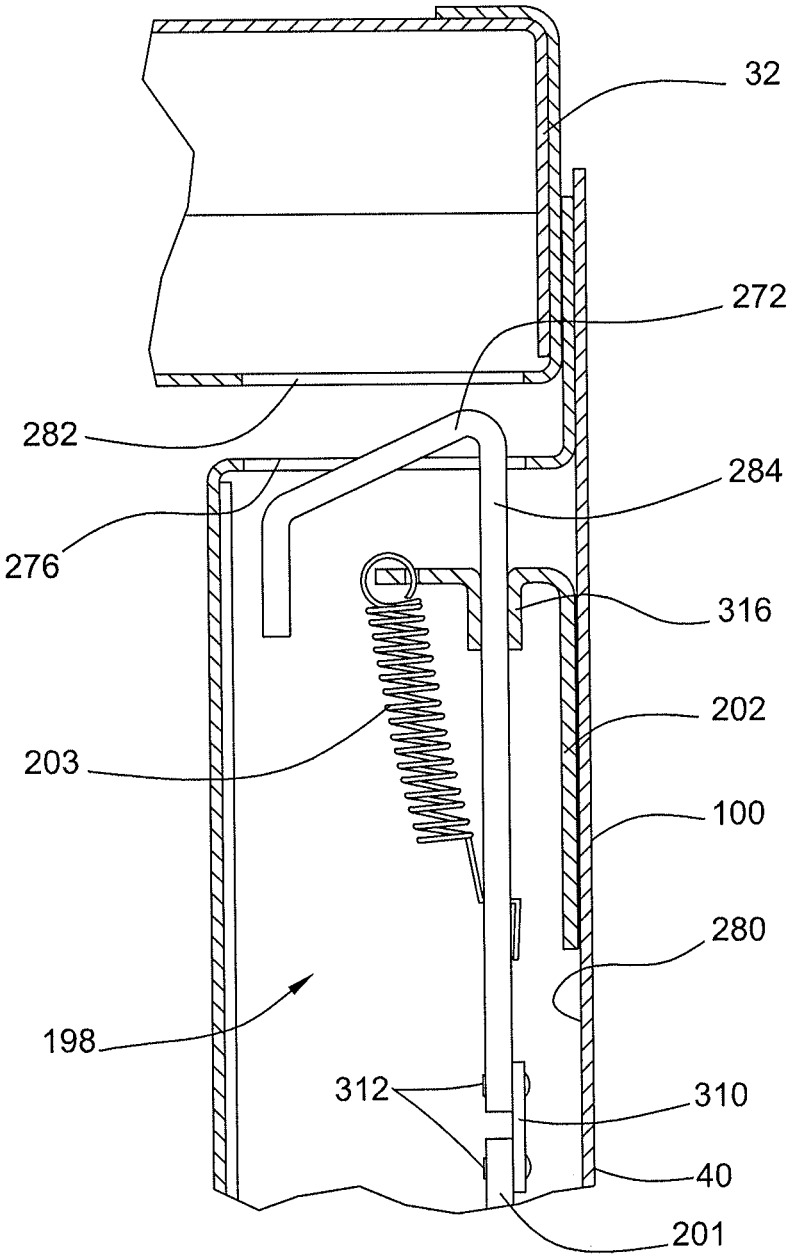
FIG. 9 is an enlarged, fragmentary end elevational view of an embodiment of an interlock mechanism constructed in accordance with principles of the present disclosure, the interlock mechanism including a mounting element, a latch rod, a fusible link, a catch, and a biasing mechanism, illustrating the catch in a retracted position.

Referring to FIGS. 3 and 4, the latch system includes a bullet slam latch 196 and first and second latch rod assemblies 198, 200. The bullet slam latch 196 can be constructed as described below and in U.S. Pat. No. 6,729,701. As shown in FIG. 9, the first latch rod assembly 198 incorporates the first interlock mechanism 51 and includes a first latch rod 201, a latch guide bracket 202, a biasing mechanism in the form of a spring 203, a fusible link 310, and a distal latch rod segment or catch 272. The second latch rod assembly 200 incorporates the second interlock mechanism 52 and includes a second latch rod 205, a latch guide bracket 206, a biasing mechanism in the form of a spring 207, a fusible link 314, and a distal latch rod segment or catch 280 (see FIG. 4). The second latch rod assembly 200 is constructed and operates in the same manner as the first latch rod assembly 198. Accordingly, only the first latch rod assembly 198 will be discussed in detail.

The first latch rod 201 comprises a mounting element of the interlock mechanism 51. The fusible link 310 interconnects the latch rod 201 and the distal latch rod segment 272, which comprises the catch of the interlock mechanism 51, such that the distal latch rod segment 272 separates from the latch rod 201 when the fusible link 310 fuses. The fusible link 310 can be fastened to the latch rod 201 and to the catch 272 by any suitable fastening means, such as, for example, by rivets 312, or by threaded fasteners or adhesives. The fusible link 310 can be any suitable fusible link. In some embodiments, the fusible link 310 is constructed such that it will fuse (i.e., melt) when the ambient temperature exceeds about 165° F.

Figure 10:
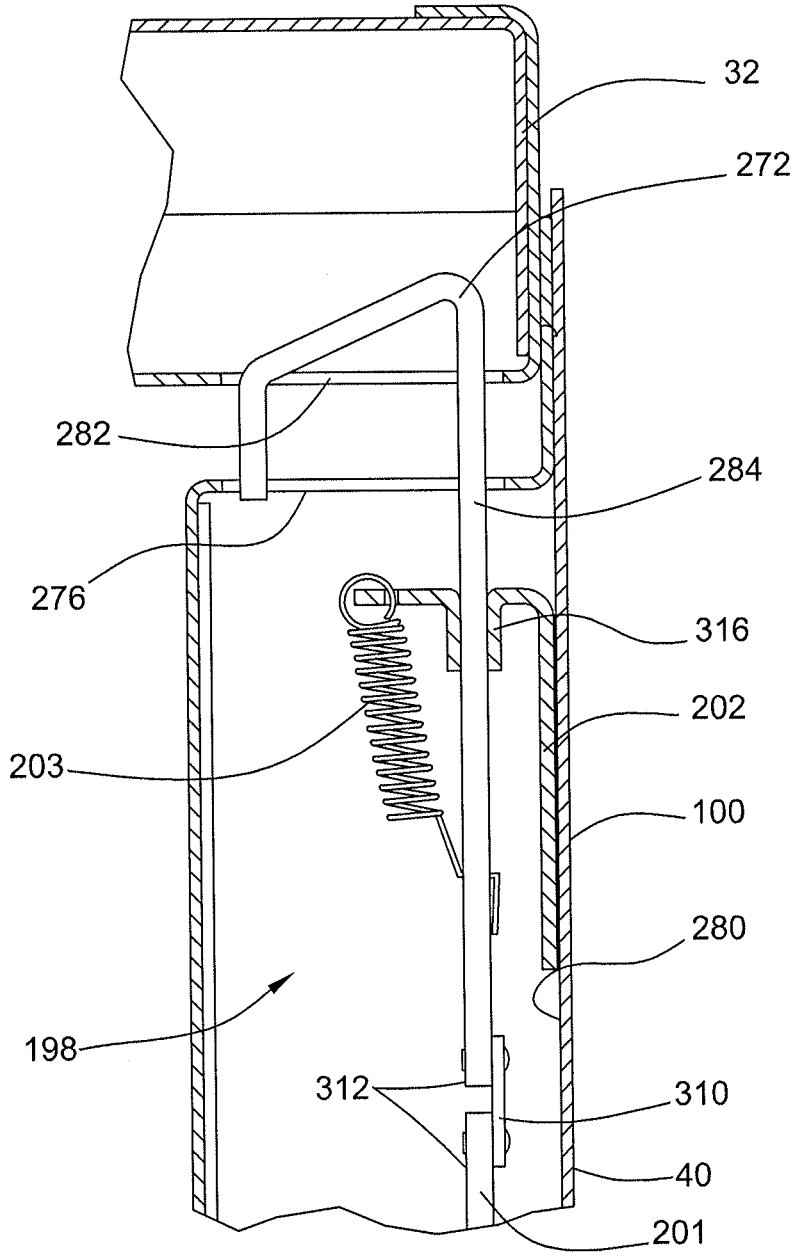
FIG. 10 is an enlarged, fragmentary end elevational view as in FIG. 9, illustrating the catch in an intermediate extended position.
Figure 11:
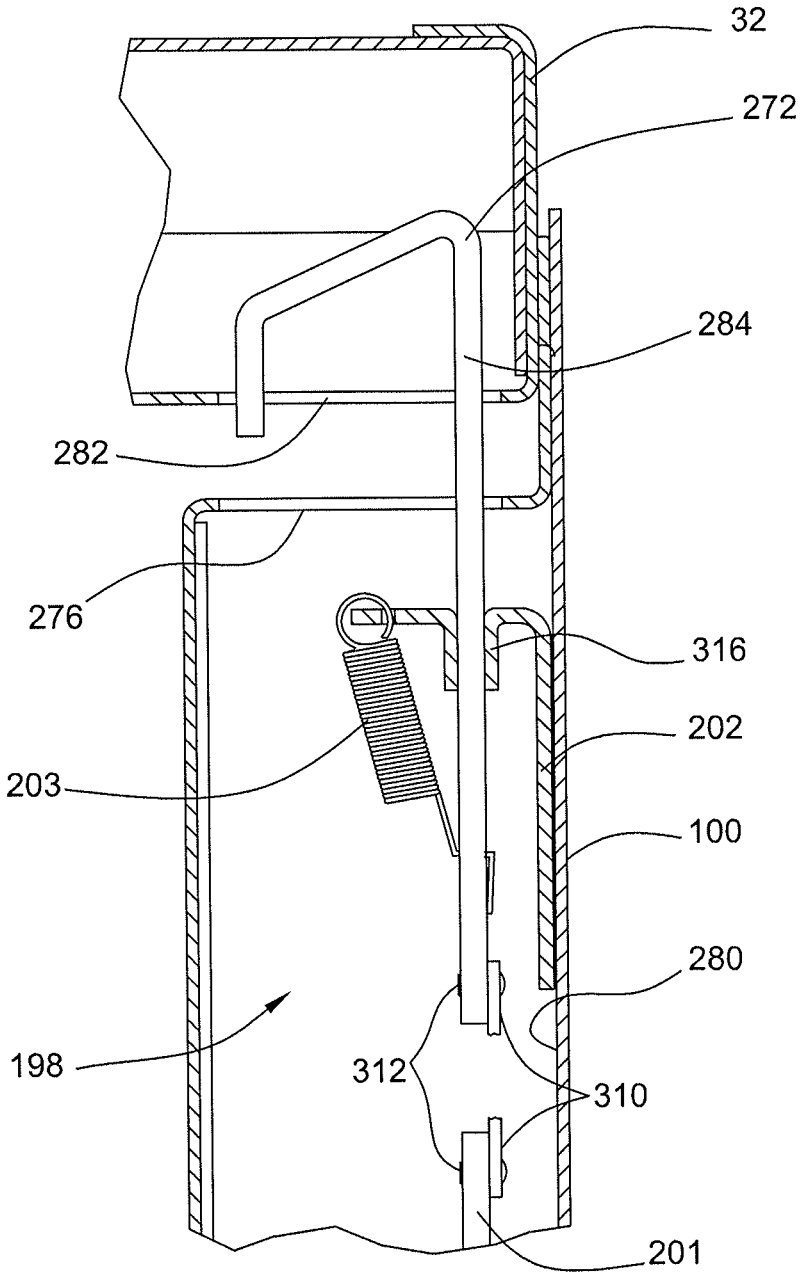
FIG. 11 is an enlarged, fragmentary end elevational view as in FIG. 9, illustrating the fusible link melted such that the catch is disconnected from the mounting element, and illustrating the catch in am interlocked position.

The catch 272 is in the form of a distal bevel end and is moveable over a range of travel between a retracted position, an intermediate extended position, and an interlocked position (as shown in FIGS. 9, 10, and 11, respectively). The intermediate extended position is disposed between the retracted position and the interlocked position. The latch system 46 is operable to selectively move the catch 272 of the interlock mechanism 51 over a range of travel between the retracted position and the intermediate extended position in which the catch 272 is in interfering relationship with the door 40 and the enclosure 32.

Referring to FIG. 10, the spring 203 urges the distal bevel end 272 of the latch rod assembly 198 toward the intermediate extended position under ambient temperatures below the fuse threshold for the link 310. The fusible link 310 prevents the distal latch rod segment 272 from moving beyond the intermediate extended position toward the interlocked position until the fusible link 310 melts at the predetermined temperature.

Referring to FIGS. 1 and 10, the latch system 46 includes a paddle handle 212 adapted to selectively actuate the latch system 46 to move the first and second distal bevel ends or catches 272 from the intermediate extended position to the retracted position. The distal bevel end 272 of the latch rod segment can move from the intermediate extended position to the retracted position either upon actuation of the paddle handle 212 or by engagement of the distal bevel end 272 with the jamb of the enclosure. A key-operated lock 213 can be provided to selectively prevent the actuation of the paddle handle 212 by unauthorized users, namely those who are not in possession of a key configured to unlock the paddle handle 212.

When the distal bevel end 272 is aligned with the upper latch aperture 282, the spring 203 urges the latch rod 201 upward so that the distal bevel end 272 is in the intermediate extended position and remains in the intermediate extended position when the right door 40 is closed. The fusible link 310 acts as a stop to prevent the distal bevel end 272 from moving past the intermediate extended position toward the interlocked position.

Referring to FIG. 11, the spring 203 urges the distal bevel end 272 to the interlocked position when the fusible link 310 fuses, i.e., when the ambient temperature reaches a threshold level and the link 310 breaks. Upon fusing, the distal bevel end 272 of latch rod 201 separates from the remainder of latch rod 201, as shown. Due to the spring force remaining in the spring 203, the distal bevel end 272 is then urged further through the upper latch aperture 282 to the interlocked position.

Travel of the latch rod 201 is guided by a latch guide bracket 202. A flange 316 of the latch guide bracket 202 can be adapted such that after the fusible link 310 fuses, the separated distal bevel end 272 of latch rod 201 remains aligned with both the upper latch aperture 282 and the opening 276 of the right door 40. The latch guide bracket 202 is mounted to an inner surface 280 of the outer door panel 100 of the right door 40. The spring 203 is provided adjacent the distal bevel end 272 to bias the latch rod 201 to the extended position in normal ambient temperatures such that the distal bevel end 272 projects from an opening 276 of the right door 40. The spring 203 is mounted to the latch rod 201 and to the latch guide bracket 202.

After the fusible link 310 fuses, the increased protrusion of the distal bevel end 272 of the latch rod 201 through the upper latch aperture 282 of enclosure 32 imparts increased rigidity to the safety cabinet 30. The increased rigidity helps the periphery of enclosure 32 to remain in contact with the periphery of doors 38, 40, reducing the likelihood that the contents of the safety cabinet 30 are exposed to flame and increased temperature.

A removable access panel can be provided to allow a user access to each distal bevel end of the latch rods 201, 205 in the event that the links 310, 314 fuse and the separated distal latch rod segments are in the interlocked position. The user can use each access panel to access the bevel ends 272, 280 when in the interlocked position and disengage the bevel ends 272, 280 from the respective jamb to which it is interlocked to allow the door to move from the closed position to an open position.

The fusible links 122, 126 of the automatic closure system 44 can be selected such that they fuse at an ambient temperature that is lower than the fusible links 310, 314 of the interlock mechanisms 51, 52. Accordingly, the doors 38, 40 of the safety cabinet 30 can automatically move to the closed position when the ambient temperature reaches a first level and the fusible links 122, 126 of the automatic closure system 44 fuse. After the doors 38, 40 have closed and the ambient temperature continues to increase, the fusible links 310, 314 of the interlock mechanisms 51, 52 can fuse at a second, higher level causing the distal bevel ends 272, 280 of the latch rods 201, 205 at the top and bottom of the door 40 to move to the interlocked positions and protrude further into the enclosure 32.

The safety cabinet 30 can be similar in construction and functionality in other respects to the safety cabinets shown and described in U.S. Pat. No. 6,729,701, which is incorporated in its entirety herein by this reference. For example, the other components of the latch system 46, the retaining system 42, and the closure system 44 can be similar to those shown and described in the '701 patent. In other embodiments, the safety cabinet can be similar in construction and functionality in other respects to the safety cabinet shown and described in U.S. Patent Application Publication No. US2008/0106174, which is incorporated in its entirety herein by this reference.

Figure 12:
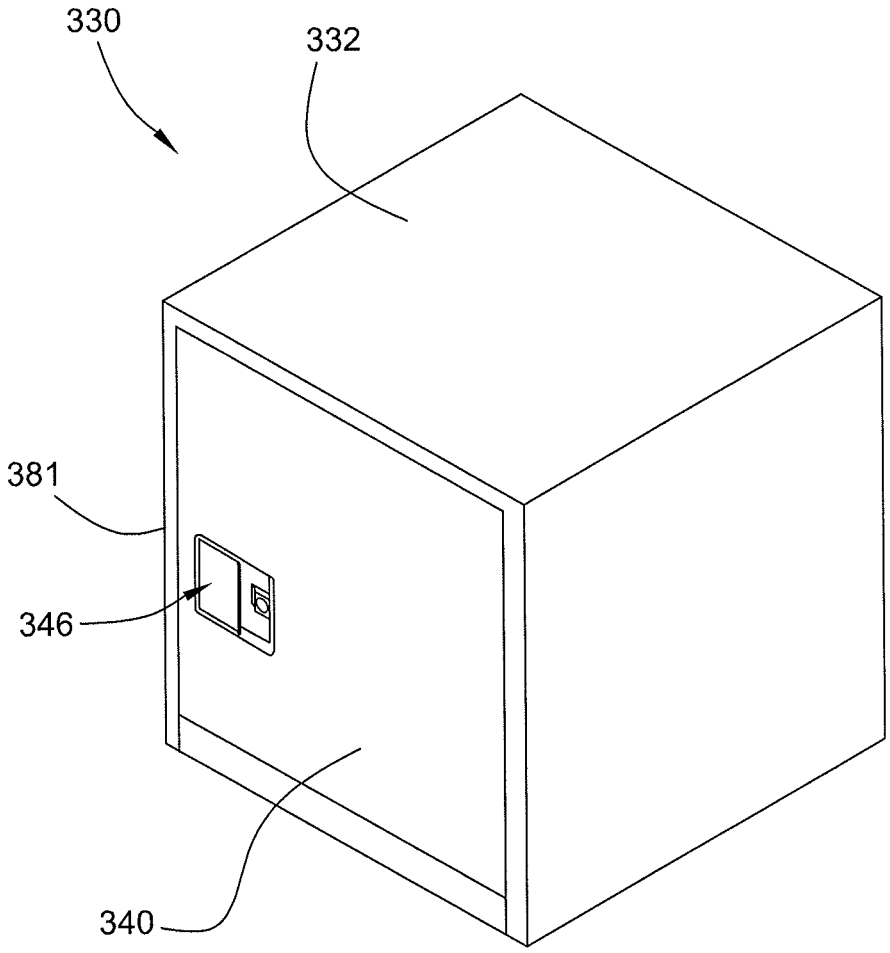
FIG. 12 is a perspective view of another embodiment of a safety cabinet constructed in accordance with principles of the present disclosure.

Referring to FIG. 12, another embodiment of a safety cabinet 330 is shown which includes an enclosure 332 and a single door 340 having a latch system 346. The latch system 346 shown in FIG. 12 is similar to the latch system 46 shown in FIG. 1. Referring to FIG. 12, the bullet catch of the bullet slam latch can be adapted to engage the left jamb 381 of the enclosure to latch the door 340 in the closed position.

Figure 13:
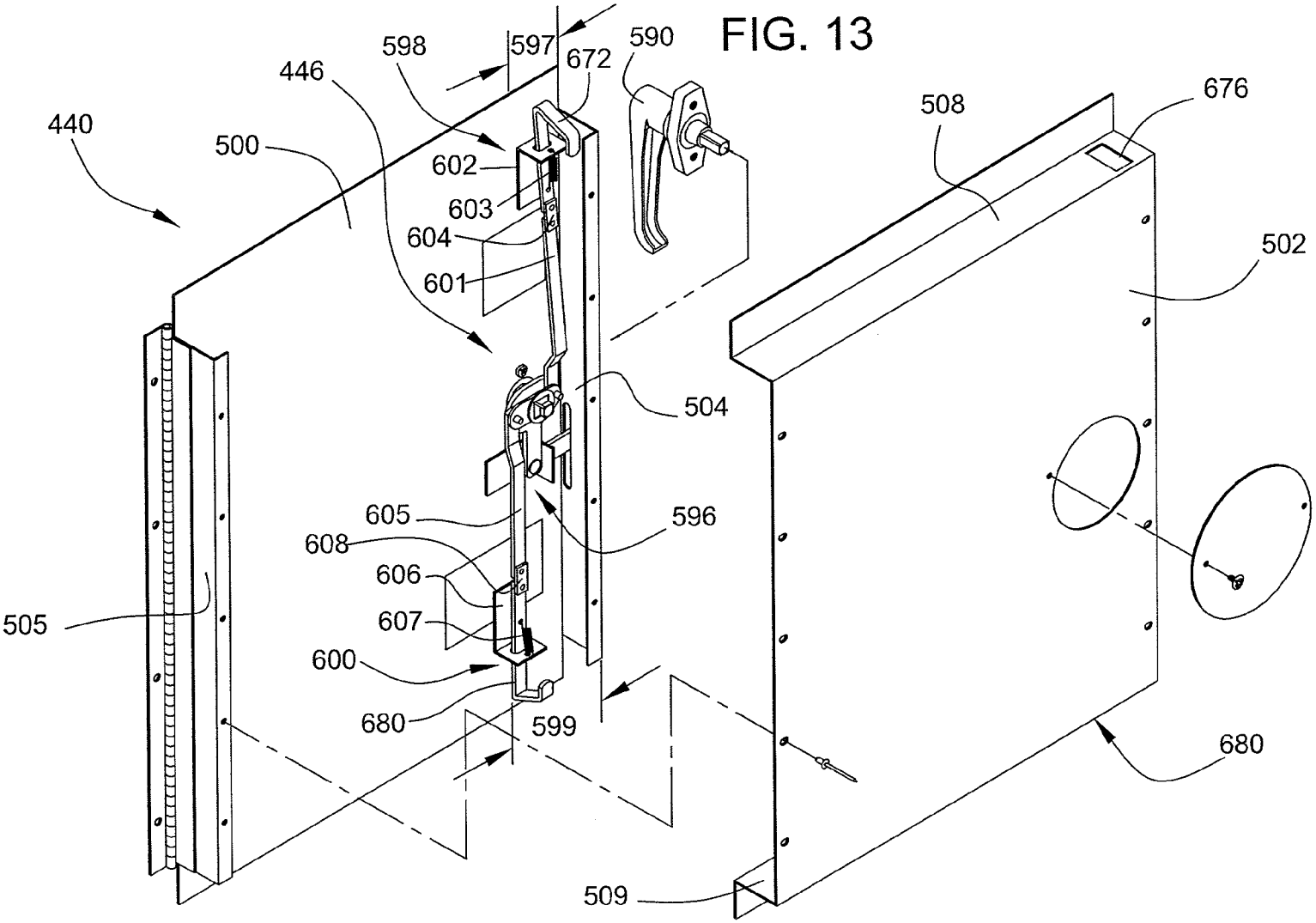
FIG. 13 is an exploded view of another embodiment of a door, a latch system, and a pair of interlock mechanisms constructed in accordance with principles of the present disclosure and suitable for a safety cabinet constructed in accordance with principles of the present disclosure.

Referring to FIG. 13, another embodiment of a door 440 is shown. A latch system 446 is disposed in the interior of the double-walled door. The latch system 446 includes a handle 590, a cam latch 596, and first and second latch rod assemblies 598, 600. The first latch rod assembly 598 incorporates an interlock mechanism and includes a first latch rod 601, a latch guide bracket 602, a spring 603, a fusible link 604, and a distal latch rod segment or bevel end 672. The second latch rod assembly 600 incorporates an interlock mechanism and includes a second latch rod 605, a latch guide bracket 606, a spring 607, a fusible link 608, and a distal latch rod segment or bevel end 680. The fusible links 604, 608 can operate as described above to allow the first and second latch rods assemblies 598, 600 to be movable over a range of travel from a retracted position, in which the door 440 can move from a closed position to an open position, to an intermediate extended position, in which the door 440 is retained in the closed position relative to the enclosure, and to an interlocked position after the fusible links 604, 608 fuse, in which the distal latch rod segments 672, 680 are further interlocked with the enclosure, to help prevent the doors 440 from opening when the safety cabinet to which the door is mounted is subjected to thermal conditions sufficient to melt the fusible links 604, 608.

Figure 14:
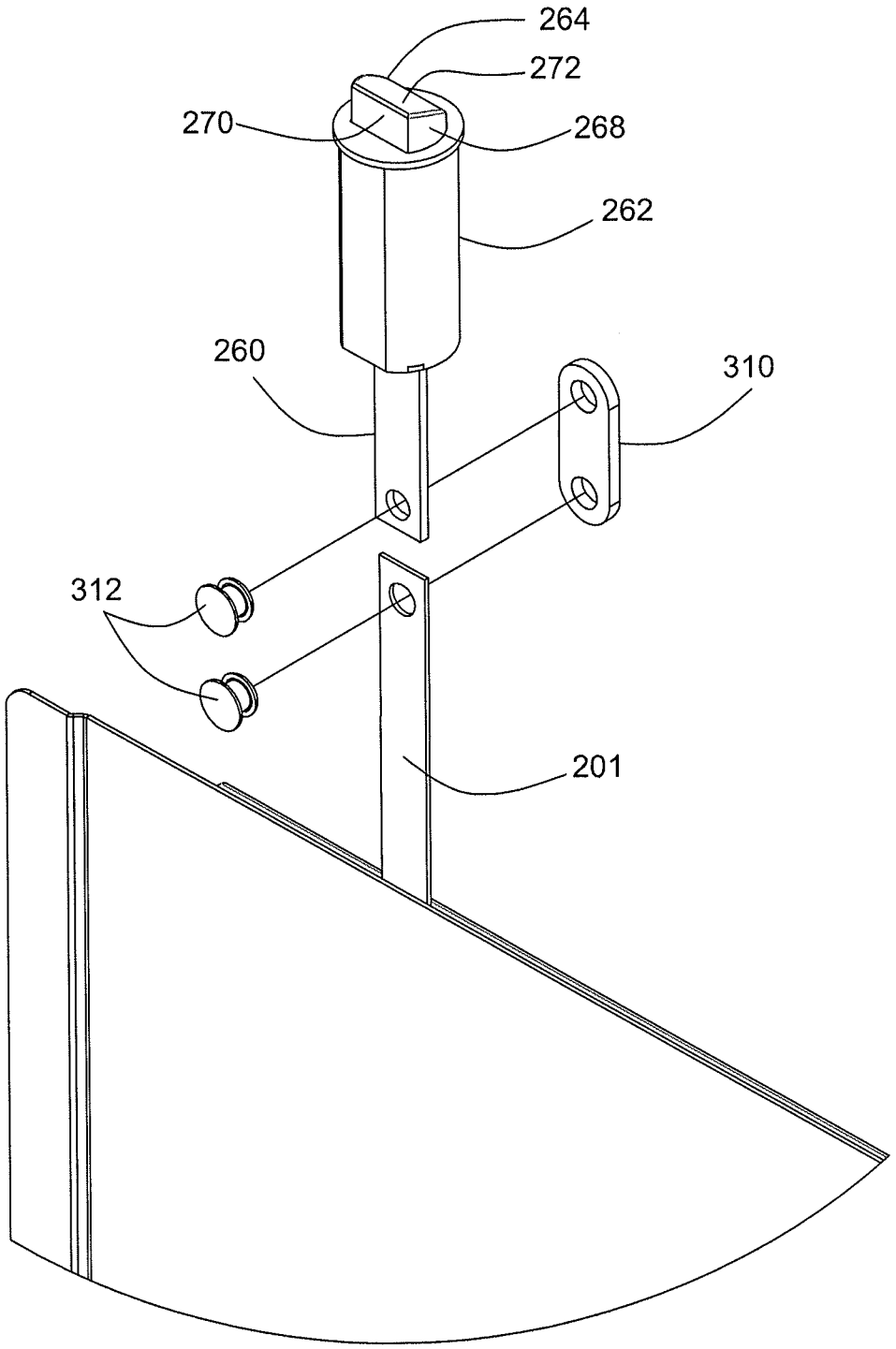
FIG. 14 is an enlarged, fragmentary perspective exploded view of another embodiment of an interlock mechanism constructed in accordance with principles of the present disclosure, the interlock mechanism including a catch in the form of a bullet slam latch.
Figure 15:
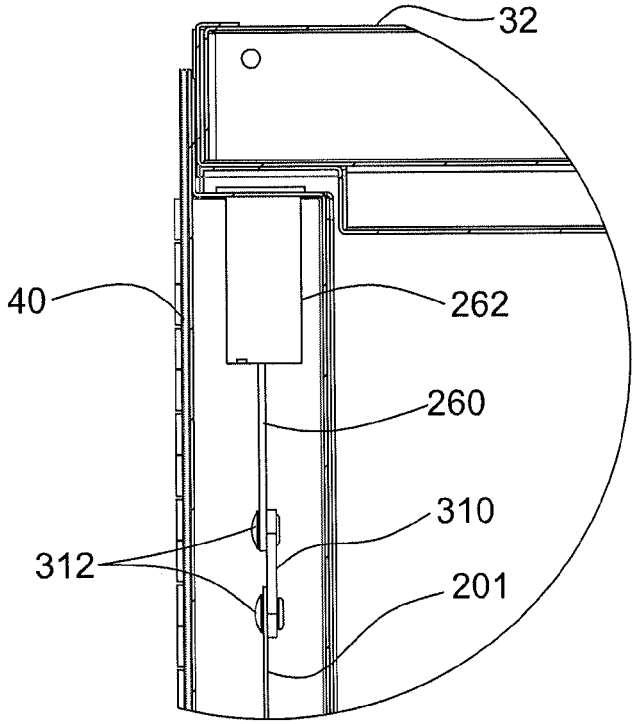
FIG. 15 is an enlarged, fragmentary end elevational view, illustrating a bullet catch of the interlock mechanism of FIG. 14 in a retracted position.
Figure 16:
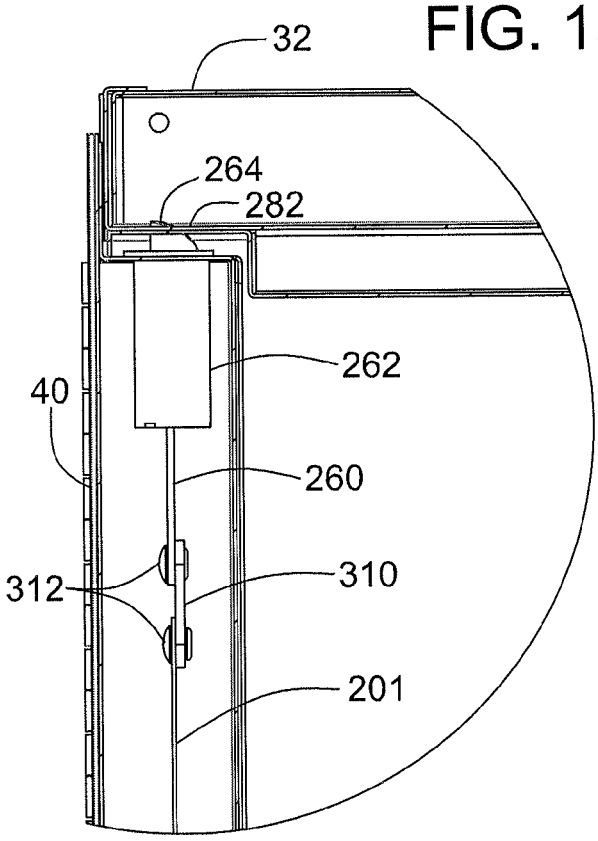
FIG. 16 is an enlarged, fragmentary end elevational view as in FIG. 15, illustrating the bullet catch of the interlock mechanism of FIG. 14 in an intermediate extended position.
Figure 17:
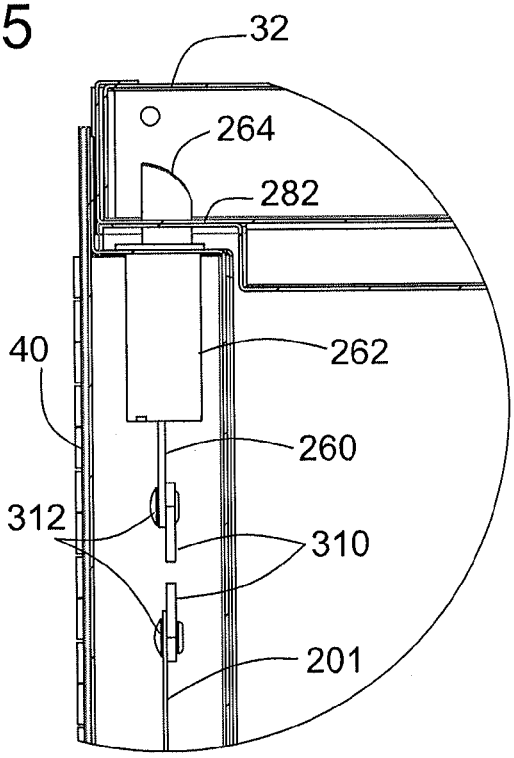
FIG. 17 is an enlarged, fragmentary end elevational view as in FIG. 15, illustrating bullet catch of the interlock mechanism of FIG. 14 in an interlocked position.

Referring to FIG. 14, in another aspect of the present disclosure, distal latch rod segments of the first and second latch rod assemblies 198, 200 of latch system comprise bullet slam latches. Each bullet slam latch includes a guide rod 260, a canister 262, and a bullet catch 264. The guide rod 260 extends from the canister 262 and is attached to the distal end of the latch rod 201 via a fusible link 310. The canister 262 is hollow and acts to house the guide rod 260 and the catch 264. The bullet catch 264 includes a catch pin and a tapered distal end 268 having a planar surface 270 and a rounded surface 272. The catch pin is disposed in a slot in the guide rod 260 and defines the limits of the travel of the bullet catch 264. The bullet catch 264 is moveable over a range of travel between a retracted position, an intermediate extended position, and an interlocked position (as shown in FIGS. 15, 16, and 17, respectively). The fusible link 310 is connected to the bullet catch 264 such that the catch is prevented from moving from the intermediate extended position to the interlocked position, but is allowed to move over a range of travel between the retracted position and the intermediate extended position. A compression spring disposed inside the canister 262 biases the bullet catch 264 to the intermediate extended position in normal ambient temperatures (limited by the fusible link 310) such that the tapered distal end 268 projects from the door 40.

Figure 19:
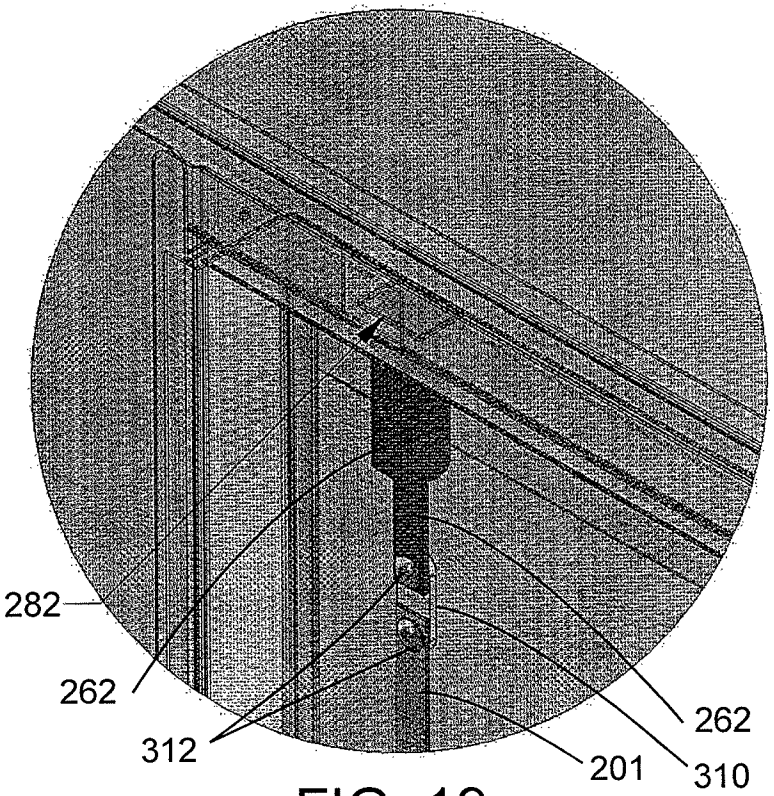
FIG. 19 is an enlarged, detail view taken from FIG. 18 as indicated by the circle in FIG. 18.
Figure 18:
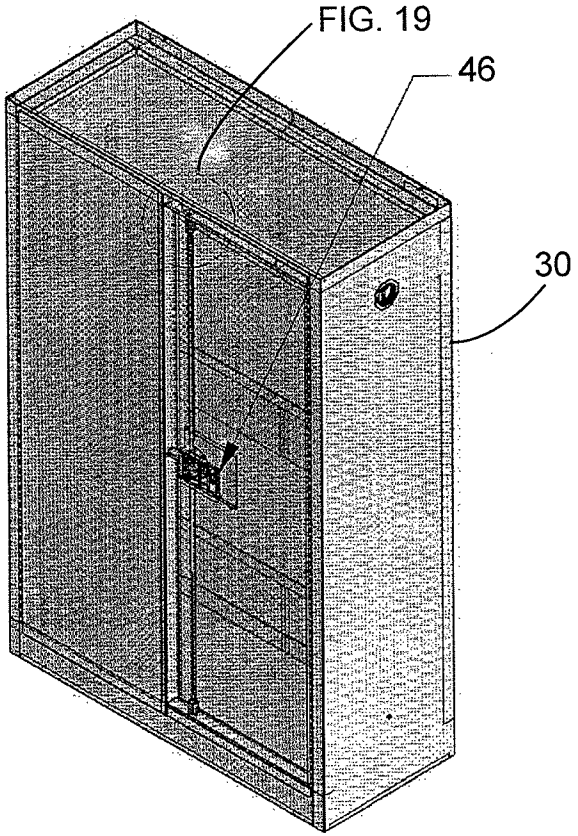
FIG. 18 is a perspective view of a safety cabinet constructed in accordance with principles of the present disclosure and including the interlock mechanism of FIG. 14.

FIG. 15 shows the bullet catch 264 in the retracted position. When the handle of the latch system is operated, the latch rod 201 causes the guide rod 260 to move in a bullet slam latch retracting direction, thereby moving the bullet catch 264 to a retracted position and allowing the right door 40 to be opened. FIG. 19 depicts another view of the bullet catch 264 in the retracted position. The bullet catch 264 can also be moved from the intermediate extended position to the retracted position when the door is moved from an open position to the closed position without the need to operate the paddle handle.

FIG. 16 shows the bullet catch 264 in the intermediate extended position. In the intermediate extended position, the bullet catch 264 provides a latch point for the latch system to selectively retain the door 40 in the closed position. Specifically, in the intermediate extended position, the bullet catch 264 protrudes from the door 40 through the upper latch aperture 282 of enclosure 32.

FIG. 17 shows the bullet catch 264 in the interlocked position. When the ambient temperature reaches a predetermined threshold level, the fusible link 310 that connects the guide rod 260 of the bullet slam latch to the latch rod 201 fuses, and the spring disposed inside the canister 262 of the bullet slam latch urges the bullet catch 264 from the intermediate extended position to the interlocked position, as shown. The increased projection of the bullet catch 264 of the bullet slam latch through the upper latch aperture 282 of the enclosure 32 further interlocks the door with the enclosure and imparts increased rigidity to the safety cabinet 30. The increased rigidity helps the periphery of enclosure 32 to remain in contact with the periphery of doors 38, 40, thereby reducing the likelihood that the contents of the safety cabinet 30 are exposed to flame and increased temperature.

Figure 20:
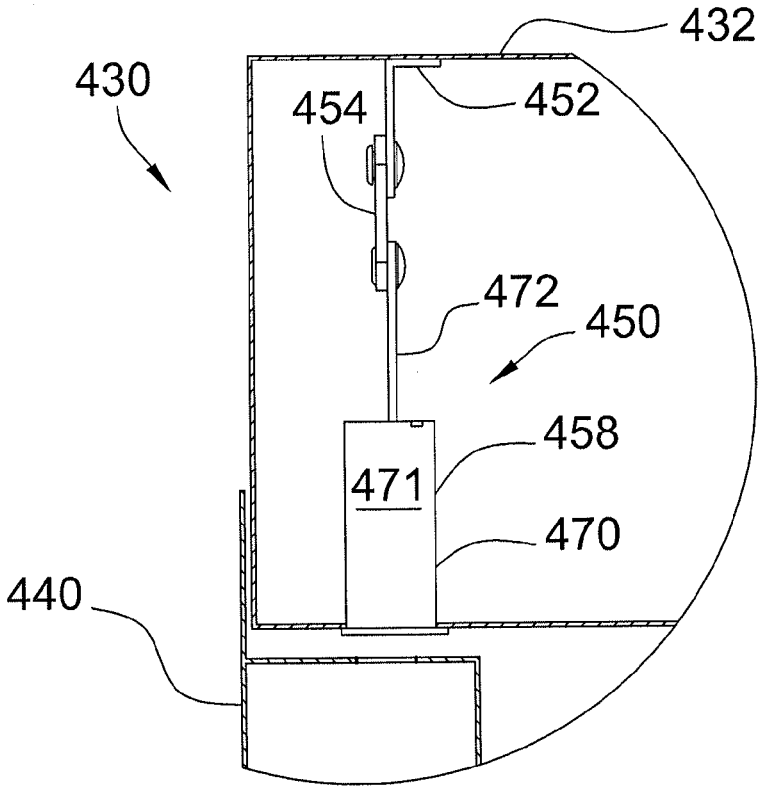
FIG. 20 is an enlarged, fragmentary end elevational view, illustrating an embodiment of an interlock mechanism constructed in accordance with principles of the present disclosure mounted in a safety cabinet, the interlock mechanism illustrated in a retracted position.
Figure 21:
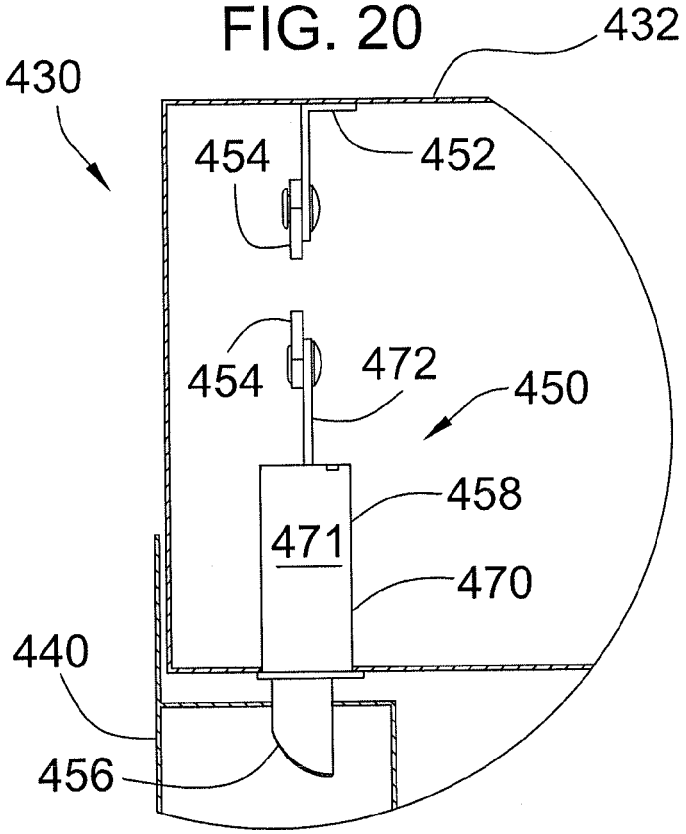
FIG. 21 is an enlarged, fragmentary end elevational view as in FIG. 20, illustrating the interlock mechanism in an interlocked position.

Referring to FIGS. 20 and 21, another embodiment of an interlock mechanism 450 is shown. The interlock mechanism 450 is disposed within an enclosure 432 of a safety cabinet 430 such that it can be selectively interlocked with a door 440.

The interlock mechanism 450 includes a mounting element 452, a fusible link 454, a catch 456, and a biasing mechanism 458. The mounting element 452 is secured to the enclosure 432. The illustrated mounting element 452 of the interlock mechanism 450 is disposed within the enclosure 432 and is mounted thereto.

The fusible link 454 interconnects the mounting element 452 and the catch 456. The catch 456 is in the form of a bullet catch of a bullet slam latch 470 and is movable over a range of travel between a retracted position (FIG. 20), in which the catch 456 is in non-interlocking relationship with the door 440 and the enclosure 432, and an interlocked position (FIG. 21), in which the catch 456 is in interlocking relationship with the door 440 and the enclosure 432 when the door 440 is in the closed position to constrain relative movement between the door 440 and the enclosure 432. The biasing mechanism 458 comprises the compression spring of the bullet slam latch 470 housed within a canister 471 thereof and is arranged with the catch 456 to urge the catch 456 to the interlocked position.

The fusible link 454 is connected to the catch 456, via a guide rod 472 of the bullet slam latch 470 such that the catch 456 is constrained from moving to the interlocked position by the fusible link 454. The fusible link 454 is configured to melt at a predetermined temperature to thereby disconnect the catch 456 from the mounting element 452 to allow the biasing mechanism 458 to move the catch 456 relative to the mounting element 452 to the interlocked position.

In other embodiments, the latch system can be used with different door and handle arrangements. Furthermore, the latch actuating mechanism can be any suitable latch actuating mechanism.

In one embodiment following principles of the present disclosure, a safety cabinet includes a three-point latch system. The latch system can be housed within a door of the safety cabinet. The door is movable over a range of travel from an open position, in which an opening to the interior of the safety cabinet is accessible, to a closed position, in which the door acts to cover at least a portion of an opening to the interior of the enclosure. The latch system can include a bullet slam latch and two latch rods each with a distal latch segment having a distal bevel end and an inclined portion. The latch rods are adapted to engage, respectively, upper and lower jambs of the enclosure. The bullet slam latch is adapted to engage either a side jamb of the enclosure or a second door which cooperates with the first door to selectively cover the opening of the enclosure.

To move the door from the closed position to an open position, a handle, such as a paddle handle, for example, of the latch system can be actuated to move the bullet slam latch and both the first and the second latch rods to a respective retracted position. Once the handle has been operated, the bullet slam latch and the first and second latch rods move in response thereto to the retracted positions. To move the door from an open position to the closed position, the handle can be used to retract the bullet slam latch and the first and second latch rods. Operating the handle moves the bullet slam latch from an extended position to the retracted position and each of the first and second latch rods from an intermediate extended position to the retracted position.

The latch assembly can also be adapted to allow the door to move to the closed position without operation of the handle. The bullet slam latch and the first and second latch rods can be adapted such that they can move from the extended position and the intermediate extended positions, respectively, in response to continued movement of the door from an open position to the closed position. In use, the door can be moved from an open position to the closed position. The catch of the bullet slam latch and the distal latch segments of the first and second latch rod assemblies can move toward the retracted position as the door contacts the jamb and/or the other door of the safety cabinet. Continued movement of the door to the closed position allows the catch of the bullet slam latch and the distal latch rod segments of the latch rod assemblies to continue to move toward the retracted position to allow the door to move to the closed position such that the catch of the bullet slam latch and the distal latch rod segments respectively align with apertures in the enclosure/other door. Once so aligned, the catch and the distal latch rod segments are urged by a biasing mechanism to return to the extended position and the intermediate extended position, respectively to secure the door in the close position.

Each latch rod assembly has a fusible link and a distal latch rod segment having a distal bevel end. The fusible link can be used to connect the distal latch rod segment to the respective latch rod. When the ambient temperature rises above a certain threshold, the fusible links fuse, (i.e., melt), thereby allowing a respective biasing mechanism, such as, a spring, for example, to move each separated distal latch rod segment of the latch rods from the intermediate extended position to an interlocked position to even further engage the enclosure. In this interlocked position, the distal bevel ends of the latch rods help prevent the secured door(s) from opening in response to warping of the safety cabinet caused by increased ambient temperature.

In another embodiment following principles of the present disclosure, a safety cabinet can include a three-point latch system disposed within a door mounted to an enclosure thereof. The door is movable over a range of travel from an open position, in which an opening to the interior of the enclosure is accessible, to a closed position, in which the door acts to cover at least a portion of the opening. The latch system can include a pair of bullet slam latches mounted, respectively, to a distal end of a latch rod and a third intermediate bullet slam latch. The bullet slam latches connected to the distal ends of the latch rods are adapted to engage, respectively, upper and lower jambs of the enclosure. The intermediate bullet slam latch is adapted to engage either a side jamb of the enclosure or a second door which cooperates with the first door to selectively cover the opening of the enclosure. The first and second bullet slam latches are connected to the two latch rods by a respective fusible link. Each bullet slam latch includes a reciprocally movable catch movable over a range of travel from a retracted position to an intermediate extended position and further to an interlocked position. Each fusible link is arranged with a respective catch of the bullet slam latch to limit the movement of the catch such that the catch is movable over a range of travel between the retracted position and the intermediate extended position. Each bullet slam latch includes a spring to bias the catch to the intermediate extended position such that one catch projects from each of a first, a second, and a third opening of the door to engage the enclosure (or a second door in some embodiment).

The catches of the bullet slam latches connected to the first and second latch rods can move to the interlocked position once the fusible link connecting the bullet slam latch to the respective latch rod fuses. Under normal operating conditions, the spring in the bullet slam latch biases the catch to the intermediate extended position, and the fusible link prevents the spring from moving the catch beyond the intermediate extended position to the interlocked position. When the ambient temperature rises above a certain level, the fusible link fuses, thereby separating the bullet slam latches from the first and second latch rods, respectively, and causing the spring of each separated bullet slam latch to move the catch to the interlocked position. In the interlocked position, the catch of the bullet slam latch further engages the enclosure, decreasing the likelihood of the door opening due to increased ambient temperature.

In still another embodiment following principles of the present disclosure, a safety cabinet can include a three-point latch system and at least one interlock mechanism. The interlock mechanism can be disposed in a jamb of an enclosure of the safety cabinet or any other suitable location for selectively engaging a door of the safety cabinet when the ambient temperature exceeds a threshold level. The interlock mechanism can include a fusible link, a distal latch segment, and a biasing mechanism adapted to move the distal latch segment from a first position to a second position.

In the first position, the latch segment is disengaged from a door of the safety cabinet. In the second position, the latch segment is in interlocking relationship with respect to a door such that the latch segment extends through an aperture of the door to prevent the door from moving from the closed position. When the ambient temperature is below a threshold level, the fusible link prevents the distal latch segment from moving from the first position to the second position. However, when the ambient temperature exceeds the threshold level, the fusible link fuses and the biasing mechanism is allowed to move the distal latch segment from the first position to the second position so that the latched segment extends through the aperture of the door to further interlock the door and the enclosure.

In one arrangement, the interlock mechanism can be in the form of a bullet slam latch and a fusible link wherein the fusible link is connected to the catch of the bullet slam latch and another element of the safety cabinet such that the fusible link constrains the movement of the distal latch segment, in this case in the form of the catch, from moving to the interlocked position. The connection of the fusible link to the catch can be configured such that the un-fused fusible link retains the catch in the retracted position in some embodiments.

In embodiments following principles of the present disclosure, an interlock mechanism constructed in accordance with principles of the present disclosure includes a fusible link, a latch segment, and a biasing mechanism adapted to move the latch segment to an interlocked position. The distal latch segment is movable to a retracted position in which the latch segment is in non-interfering relationship with a door and an enclosure of a safety cabinet to allow the door to move from the closed position to the open position. When the latch segment is in the interlocked position, the latch segment is in interlocking relationship with respect to the door and the enclosure such that the latch segment restrains the door from moving from the closed position. When the fusible link is below a threshold temperature, the fusible link prevents the latch segment from moving to the interlocked position, and, when the fusible link exceeds the threshold temperature, the fusible link melts to allow the biasing mechanism to move the latch segment to the interlocked position.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the present disclosure (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the present disclosure and does not pose a limitation on the scope of the present disclosure unless otherwise claimed. No language in the specification should be construed as indicating any non-claimed element as essential to the practice of the present disclosure.

Preferred embodiments of this present disclosure are described herein, including the best mode known to the inventors for carrying out the present disclosure. Of course, variations of those preferred embodiments will become apparent to those of ordinary skill in the art upon reading the foregoing description. The inventors expect skilled artisans to employ such variations as appropriate, and the inventors intend for the present disclosure to be practiced otherwise than as specifically described herein. Accordingly, this present disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A safety cabinet comprising:

an enclosure defining an opening;

a door rotatably attached to the enclosure, the door moveable between an open position and a closed position, the door configured to selectively cover at least a portion of the opening of the enclosure when in the closed position;

an interlock mechanism arranged with at least one of the enclosure and the door, the interlock mechanism including a mounting element, a fusible link, a catch, and a biasing mechanism, wherein:

the fusible link interconnects the mounting element and the catch, the catch is movable over a range of travel between a retracted position, in which the catch is in non-interlocking relationship with the door and the enclosure, and an interlocked position, in which the catch is in interlocking relationship with the door and the enclosure when the door is in the closed position to constrain relative movement between the door and the enclosure, the biasing mechanism is arranged with the catch to urge the catch to the interlocked position, and the fusible link is connected to the catch such that the catch is constrained from moving to the interlocked position by the fusible link, and the fusible link is configured to melt at a predetermined temperature to thereby disconnect the catch from the mounting element to allow the biasing mechanism to move the catch relative to the mounting element to the interlocked position;

a latch system arranged within the door to selectively retain the door in the closed position, the latch system including a first latch rod assembly, the first latch rod assembly having a latch rod comprising the mounting element of the interlock mechanism and a distal latch rod segment comprising the catch of the interlock mechanism, the distal latch rod segment connected to the latch rod with the fusible link of the interlock mechanism, the latch system operable to selectively move the catch of the interlock mechanism over a range of travel between the retracted position and an intermediate extended position in which the catch is in interfering relationship with the door and the enclosure, the intermediate extended position disposed between the retracted position and the interlocked position, and the fusible link connected to the catch such that the catch is prevented from moving from the intermediate extended position to the interlocked position until the fusible link melts at the predetermined temperature.

2. The safety cabinet of claim 1, wherein the distal latch rod segment includes a distal bevel end, and the catch of the interlock mechanism comprises the distal bevel end of the distal latch rod segment.

3. The safety cabinet of claim 1, wherein the distal latch rod segment includes a bullet slam latch, the catch of the interlock mechanism comprising the bullet slam latch, the bullet slam latch including a guide rod, a canister, and a bullet catch, the bullet catch disposed within the canister and moveable over a range of travel between a retracted position, an intermediate extended position, and the interlocked position, the bullet catch biased to the interlocked position, the guide rod connected to the fusible link such that the fusible link constrains the bullet catch of the bullet slam latch from moving to the interlocked position.

4. The safety cabinet of claim 1, wherein the biasing mechanism is comprises a spring cooperatively arranged with the distal latch rod segment to bias the catch to the intermediate extended position.

5. The safety cabinet according to claim 1, wherein the interlock mechanism comprises a first interlock mechanism, and the latch system includes a second latch rod assembly having a second latch rod and a second distal latch rod segment, and further comprising a second interlock mechanism associated with the second latch rod assembly.

6. The safety cabinet of claim 5, wherein the second interlock mechanism includes a second mounting element, a second fusible link, a second catch, and a second biasing mechanism, wherein:

the second fusible link interconnects the second mounting element and the second catch, the second catch is movable over a range of travel between a retracted position, in which the second catch is in non-interlocking relationship with the door and the enclosure, and an interlocked position, in which the second catch is in interlocking relationship with the door and the enclosure when the door is in the closed position to constrain relative movement between the door and the enclosure, the second biasing mechanism is arranged with the second catch to urge the second catch to the interlocked position, the second fusible link is connected to the second catch such that the second catch is constrained from moving to the interlocked position by the second fusible link, and the second fusible link is configured to melt at a predetermined temperature to thereby disconnect the second catch from the second mounting element to allow the second biasing mechanism to move the second catch relative to the second mounting element to the interlocked position, and wherein the second latch rod comprises the second mounting element of the second interlock mechanism and the second distal latch rod segment comprises the second catch of the second interlock mechanism.

7. The safety cabinet of claim 6, wherein the latch system includes a paddle handle adapted to selectively actuate the latch system to move the first and second catches from the intermediate extended position to the retracted position.

8. The safety cabinet of claim 7, wherein the latch system includes a bullet slam latch to provide a three-point latch system.

9. The safety cabinet of claim 8, wherein the first and second latch rod assemblies and the bullet slam latch are configured such that the door is movable from the open position to the closed position without the actuation of the paddle handle.

10. The safety cabinet of claim 9, further comprising:

a closure system to bias the door to the closed position.

11. The safety cabinet of claim 10, further comprising:

a retaining system to retain the door in the open position, the retaining system having a fusible link, the fusible link mounted to the door and to the enclosure, the fusible link being configured such that the fusible link will melt when the ambient temperature is at a second predetermined temperature to thereby detach the fusible link from the enclosure to allow the closure system to move the door to the closed position the second predetermined temperature being less than the predetermined temperature of the fusible link of the interlock mechanism.

12. The safety cabinet of claim 1, wherein the mounting element of the interlock mechanism is disposed within the enclosure and mounted thereto.

13. The safety cabinet of claim 1, wherein the door includes an access panel through which the catch is accessible to allow the catch to be moved from the interlocked position to the retracted position.

14. The safety cabinet of claim 1, further comprising:

a second door rotatably attached to the enclosure, the second door being rotatable between an opened position and a closed position, the doors, when in the closed position, cooperating with each other to cover the opening of the enclosure.

15. An interlock mechanism for selectively retaining a door of a safety cabinet in a closed position, the interlock mechanism including a mounting element, a fusible link, a catch, and a biasing mechanism, wherein:

the fusible link is connected to both the mounting element and the catch;

the catch is movable over a range of travel between a retracted position and an interlocked position;

the biasing mechanism arranged with the catch to urge the catch to the interlocked position; and the fusible link is connected to the catch such that the catch is constrained from moving to the interlocked position by the fusible link, and the fusible link is configured to melt at a predetermined temperature to thereby allow the biasing mechanism to move the catch to the interlocked position;

wherein the catch comprises a bullet slam latch including a guide rod, a canister, and a bullet catch biased to the interlocked position, the guide rod connected to the fusible link such that the fusible link constrains the bullet catch of the bullet slam latch from moving to the interlocked position.

16. The interlock mechanism of claim 15, wherein the biasing mechanism comprises a spring.

17. The interlock mechanism of claim 15, wherein the bullet catch is moveable over a range of travel between the retracted position, an intermediate extended position, and the interlocked position, and the fusible link, the guide rod and the bullet catch are associated such that the bullet catch is prevented from moving from the intermediate extended position to the interlocked position at least until the fusible link melts, but is allowed to move over a range of travel between the retracted position and the intermediate extended position.

* * * * *